US011353302B1

(12) United States Patent
Steffner

(10) Patent No.: US 11,353,302 B1
(45) Date of Patent: Jun. 7, 2022

(54) BULLET COMPOSITION TREATMENT TO REDUCE FRICTION

(71) Applicant: Thomas E. Steffner, Chattanooga, TN (US)

(72) Inventor: Thomas E. Steffner, Chattanooga, TN (US)

( * ) Notice: Subject to any disclaimer, the term of this patent is extended or adjusted under 35 U.S.C. 154(b) by 0 days.

(21) Appl. No.: 15/405,851

(22) Filed: Jan. 13, 2017

(51) Int. Cl.

| | |
|---|---|
| ***F42B 12/74*** | (2006.01) |
| ***F42B 14/04*** | (2006.01) |
| ***F42B 12/82*** | (2006.01) |
| *F42B 12/34* | (2006.01) |
| *F42B 12/04* | (2006.01) |
| *F42B 12/44* | (2006.01) |

(52) U.S. Cl.
CPC ..... *F42B 12/74* (2013.01); *F42B 14/04* (2013.01); *F42B 12/04* (2013.01); *F42B 12/34* (2013.01); *F42B 12/44* (2013.01); *F42B 12/82* (2013.01)

(58) Field of Classification Search
CPC ..... F42B 12/36; F42B 12/46; F42B 12/50; F42B 12/72; F42B 12/74; F42B 12/04; F42B 12/34; F42B 12/44; F42B 12/80; F42B 12/82; F42B 14/04; F42B 12/745
See application file for complete search history.

(56) References Cited

U.S. PATENT DOCUMENTS

| | | | | |
|---|---|---|---|---|
| 1,895,207 | A * | 1/1933 | Rinkel | F42B 14/04 102/511 |
| 2,398,895 | A * | 4/1946 | Schreib | F42B 14/04 102/511 |
| 2,442,369 | A * | 6/1948 | McBride | F42B 14/02 102/526 |
| 3,267,035 | A | 8/1966 | Tillman | |
| 4,507,183 | A * | 3/1985 | Thomas | C25D 3/50 204/290.14 |
| 4,731,189 | A | 3/1988 | Gregg, Jr. | |
| 5,237,930 | A * | 8/1993 | Belanger | F42B 12/745 102/529 |
| 6,375,971 | B1 * | 4/2002 | Hansen | F42B 12/54 102/512 |
| 2008/0000379 | A1 * | 1/2008 | Hansen | F42B 7/046 102/517 |
| 2008/0035007 | A1 * | 2/2008 | Nielson | C06B 45/00 102/517 |
| 2011/0054090 | A1 * | 3/2011 | Fujita | C08J 5/18 524/120 |
| 2011/0252997 | A1 * | 10/2011 | Hoffman | F42B 12/06 102/439 |

* cited by examiner

*Primary Examiner* — James S Bergin
(74) *Attorney, Agent, or Firm* — Singleton Law, PLLC; Chainey P. Singleton

(57) ABSTRACT

The present invention provides a treated projectile having a reduced friction compared to an untreated projectile comprising: a projectile comprising a higher atomic concentration of Ca and a reduced friction in the treated projectile than a comparable untreated projectile.

6 Claims, 22 Drawing Sheets

Fe

C

Ca

C (RED) + Fe (GREEN) + Ca (BLUE)

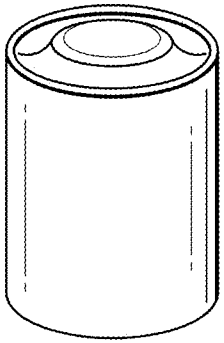
FIG. 33f
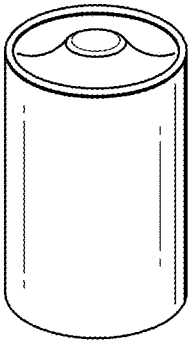
FIG. 33g
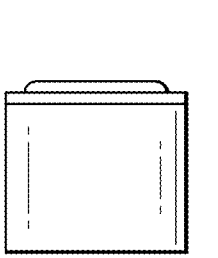
FIG. 33h
FIG. 33i
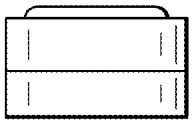
FIG. 33j
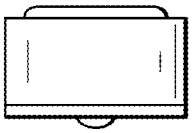
FIG. 33k

BULLET COMPOSITION TREATMENT TO REDUCE FRICTION

CROSS-REFERENCE TO RELATED APPLICATIONS

None.

TECHNICAL FIELD OF THE INVENTION

The present invention relates generally to treatments and compositions used to reduce the friction associated with a projectile.

STATEMENT OF FEDERALLY FUNDED RESEARCH

None.

INCORPORATION-BY-REFERENCE OF MATERIALS FILED ON COMPACT DISC

None.

BACKGROUND OF THE INVENTION

Without limiting the scope of the invention, its background is described in connection with treatments for projectiles and bullets. It has been recognized that projectiles transfers metals (e.g., lead, copper, zinc, aluminum, etc.) from the bullet to the interior surface of the barrel (e.g., pistols, rifles, shotguns artillery) in which they are fired and pass through. Such depositions results in fouling (be it lead, copper, zinc, aluminum or other metals) which impairs the accuracy and in extreme cases may impair the operation. It has further been recognized that a substantial reduction in lead fouling can be achieved in the case of bullets by lubricating the bullets. A type of lubricant which has been widely employed for this purpose is a tacky wax or wax-grease mixture. Although this type of lubricant does substantially alleviate the problem of lead fouling, the lubricant itself gives rise to certain other problems which render its use a far less than fully satisfactory solution to the fouling problem. For example, because of the tackiness or sticky consistency of these lubricants, there is a propensity for powder grains from the propellant to adhere to the lubricant and to remain unburned during the discharge of the cartridge. This unconsumed residue, consisting of the gummy lubricant and powder grains, accumulates in the operating mechanism of the firearm and contributes to operating difficulties. Moreover, sticky or tacky lubricants are especially objectionable when applied to externally lubricated bullets (as opposed to those lubricated internally within the case of the cartridge) as is the current practice in rimfire ammunition. Such external lubrication results in undesirable soiling of the hands of one handling the ammunition, and in the introduction of abrasive particles of dust and dirt into the firearm mechanism and bore by the propensity of the tacky lubricant surface to pick up and carry foreign materials with which it comes in contact.

U.S. Pat. No. 3,267,035, entitled, "Composition for and method of lubricating bullets and shot," discloses a composition for, and method of, lubricating bullets and shot of the type which require lubrication in order to reduce fouling of the firing mechanism and barrel of firearms. More particularly, but not by way of limitation, the present invention relates to a method for providing a dry film lubricant on lead bullets and shot which, without lubrication, foul the barrels of firearms by lead deposition thereon and which, with conventional lubricants, tend to foul the firing mechanism.

U.S. Pat. No. 4,731,189, entitled, "Bullet lubricant and method of compounding said lubricant," discloses a composition for bullet lubrication which comprises an admixture of petroleum and silicone oil metallic soap greases, molybdenum disulfide, graphite, and beeswax.

SUMMARY OF THE INVENTION

The present invention provides a treated projectile having a reduced friction compared to an untreated projectile comprising: a projectile comprising a projectile treatment that produces a higher atomic concentration of Ca in the treated projectile that reduces the friction of the projectile than a comparable untreated projectile. The treatment is not a coating, a film, or a surface treatment.

The present invention provides a treated projectile having a reduced backpressure compared to an untreated projectile comprising: a projectile comprising a treatment that produces a higher atomic concentration of Ca and a lower backpressure due to a reduced friction in the treated projectile than a comparable untreated projectile. The treatment is not a coating, a film, or a surface treatment.

The treated projectile may have a higher atomic concentration of C than a comparable untreated projectile. The treated projectile has a lower atomic concentration of O than a comparable untreated projectile. The treated projectile may have a lower atomic concentration of Fe than a comparable untreated projectile. The atomic concentration may be compared by Auger microanalysis. The treated projectile may have a frustoconical shaped nose. The frustoconical shaped nose may have a cavity to form a hollow point projectile. The treated projectile may have a spritzer shape nose. The treated projectile may have a blunted shape. The treated projectile may have a rounded shape. The treated projectile may have a full metal jacket, expanding full metal jacket, spritzer, jacketed spritzer, armor piercing, or armor piercing incendiary. The treated projectile may be a 5.56 mm, 7.62 mm, 308, 338, 3030, 3006, 50 caliber, 45 caliber, 380 caliber, 38 caliber, 9 mm, 10 mm, 12.7 mm, 14.5 mm, 14.7 mm, 20 mm, 25 mm, 30 mm, 40 mm, 57 mm, 60 mm, 75 mm, 76 mm, 81 mm, 90 mm, 100 mm, 105 mm, 106 mm, 115 mm, 120 mm, 122 mm, 125 mm, 130 mm, 152 mm, 155 mm, 165 mm, 175 mm, 203 mm, 460 mm, 8 inch, or 4.2 inch projectile. The treated projectile may be stainless steel, brass, ceramic alloys, copper/cobalt/nickel/custom alloys, tungsten, tungsten carbide, carballoy, ferro-tungsten, titanium, copper, cobalt, nickel, uranium, depleted uranium, alumina oxide, zirconia and aluminum.

The treated projectile may be stainless steel, brass, metal alloys, ceramic alloys. The treated projectile may be 102, 174, 201, 202, 300, 302, 303, 304, 308, 309, 316, 316L, 316Ti, 321, 405, 408, 409, 410, 415, 416, 416R, 420, 430, 439, 440, 446 or 601-665 grade stainless steel. The treated projectile may be a) Ca; 2-16% Ni; 10-20% Cr; 0-5% Mo; 0-0.6% C; 0-6.0% Cu; 0-0.5% Nb+Ta; 0-4.0% Mn; 0-2.0% Si and the balance Fe; b) Ca; 2-6% Ni; 13.5-19.5% Cr; 0-0.10% C; 1-7.0% Cu; 0.05-0.65% Nb+Ta; 0-3.0% Mn; 0-3.0% Si and the balance Fe; c) Ca; 3-5% Ni; 15.5-17.5% Cr; 0-0.07% C; 3-5.0% Cu; 0.15-0.45% Nb+Ta; 0-1.0% Mn; 0-1.0% Si and the balance Fe; d) Ca; 10-14% Ni; 16-18% Cr; 2-3% Mo; 0-0.03% C; 0-2% Mn; 0-1% Si and the balance Fe; e) Ca; 12-14% Cr; 0.15-0.4% C; 0-1% Mn; 0-1% Si and the balance Fe; f) Ca; 16-18% Cr; 0-0.05% C; 0-1% Mn; 0-1% Si and the balance Fe; g) Ca; 3-12% aluminum, 2-8% vanadium, 0.1-0.75% iron, 0.1-0.5% oxygen, and the remainder titanium; or h) Ca; about 6% aluminum, about 4% vanadium, about 0.25% iron, about 0.2% oxygen, and the remainder titanium.

The present invention provides a method of increasing the life of a gun barrel comprising the steps of: providing a cartridge having a treated projectile; loading the cartridge into a gun; and discharge the cartridge to fire the treated projectile through the gun barrel, wherein the life of the gun barrel is increased by the reduction in friction of the treated projectile compared to a comparable untreated projectile.

The present invention provides a method of reducing the friction between a projectile and a barrel comprising the steps of: providing a cartridge comprising a projectile comprising a projectile treatment that produces a higher atomic concentration of Ca in the treated projectile that reduces the friction of the projectile than a comparable untreated projectile; loading the cartridge into a gun; and discharge the cartridge to fire the treated projectile through the gun barrel, wherein the treated projectile has a reduced friction with the gun barrel compared to a comparable untreated projectile.

BRIEF DESCRIPTION OF THE DRAWINGS

For a more complete understanding of the features and advantages of the present invention, reference is now made to the detailed description of the invention along with the accompanying figures and in which.

DETAILED DESCRIPTION OF THE INVENTION

Figure 1:
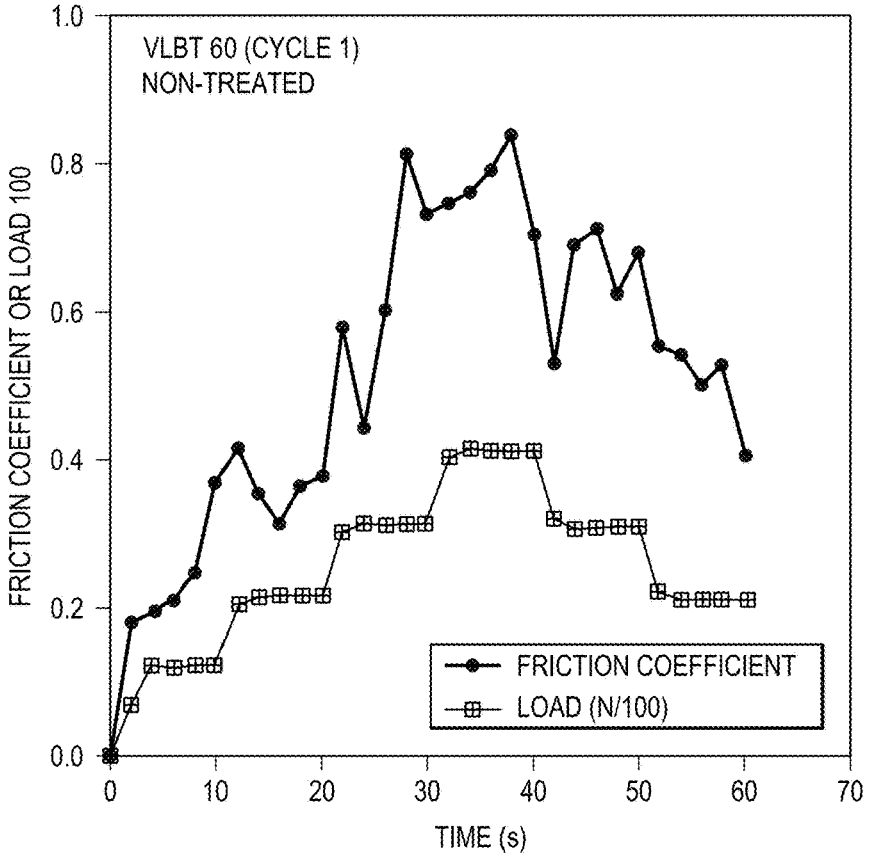
FIG. 1 is a graph of first cycle load and friction coefficient for the non-treated pair.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not delimit the invention, except as outlined in the claims.

As used herein, the term "ammunition" denotes an assembled munition that is loadable into a gun. Ammunition is comprised of a casing, an energetic material, a primer, and a projectile. The casing is typically a metallic or polymeric cylinder open at one end, contains the energetic material. The open end of the casing is sealed to the proximal end of the projectile. The distal end of the projectile is typically of an aerodynamic shape. Projectiles are also commonly known as bullets or slugs.

As used herein the term "bullet," "shell," and "projectile" are used interchangeably and denote a projectile that is positioned in an ammunition cartridge until it is expelled from a gun, rifle, or the like and propelled by detonation of a powdered chemical propellant or other propellant that may be non-powdered, solid, gaseous or gelatin and includes payload-carrying projectiles contains shot, an explosive or other filling, though modern usage sometimes includes large solid projectiles properly termed shot (AP, APCR, APCNR, APDS, APFSDS and proof shot).

As used herein, the term "small caliber ammunition" denotes ammunition up to fifty caliber.

As used herein, the term "large caliber ammunition" denotes ammunition greater than fifty caliber and includes field artillery projectiles, shells of 100, 105, 115, 120, 122, 125, 130, 152, 155, 203, 270, 280, 460, and mm diameter or larger. In addition the term may encompass a variety of types of projectiles from high-explosive shell, mine shell, armour-piercing shell, armor-piercing, discarding-sabot, armor-piercing, fin-stabilised, discarding-sabot, high-velocity armor-piercing shell, armor-piercing, composite non-rigid (i.e., squeeze-bore or tapered bore), high-explosive, anti-tank, high-explosive, squash-head (HESH), shrapnel shell, cluster shell, smoke shell, guided shells, multiple launch rocket system (MLRS), self-propelled rocket launcher projectiles, rocket assisted projectiles (RAP), etc.

As used herein, the term "caliber" denotes the interior diameter of the barrel of a gun (also known as a firearm) in hundredths of an inch; the term is also used herein with reference to munitions, and generally refers to the approximate outside diameter of the projectile of the munition, or is meant to indicate munitions that are useable in a particular caliber of gun.

As used herein, the term "cartridge" denotes an assembled munition that is loadable into a gun. A cartridge is comprised of a casing. The casing is typically a metallic or polymeric cylinder open at one end.

In general this invention comprises tailor made bullets and ammunition specifically designed for reduced friction. The projectile is treated to reduce the friction of the projectile with the bore of the barrel as it passes through. Testing has shown that the treatment can dramatically and unexpectedly reduce friction.

FIGS. 1-4 are graphs of first cycle load and friction coefficient for the non-treated pair. To determine the friction coefficients of the claimed treatment under sliding wear conditions the treatment is used on one or both surfaces of an alloy steel couple and the results compared to a non-treated steel that were tested under the same conditions. In addition, an infrared camera was used in an attempt to detect differences in frictional heating due to sliding with and without the treatment. For friction testing alloy steels were machined to fit a Variable Load Bearing Tester (VLBT) which was designed to simulate variable loads and contact pressures as might be experienced by an internal combustion engine component during operation. After machining in a condition typical of engine applications, the friction-reducing treatment of the present invention was applied to the specimens in order to investigate the combinations of sliding conditions: Contact geometry: flat plate pressed upward against a rotating cylindrical shaft; Step-loading single cycle: 20, 30, 40, 50, 40, 30 N per cycle; Time for each load step in the cycle: 10 s; Cycles of loading per experiment: 5; Total sliding distance per experiment: 30 m; and Sliding speed: 0.1 m/s from this it is clear to see that the instant invention dramatically and unexpectedly reduces the friction between the surfaces.

FIG. 1 shows the load spectrum and the corresponding friction coefficients for the first cycle for run number VLBT 60. FIG. 1 shows the first cycle load and friction coefficient for the non-treated pair. Note that the load is divided by 100 to fit on the same vertical scale. The friction coefficient rises and falls similar to the load.

Figure 2:
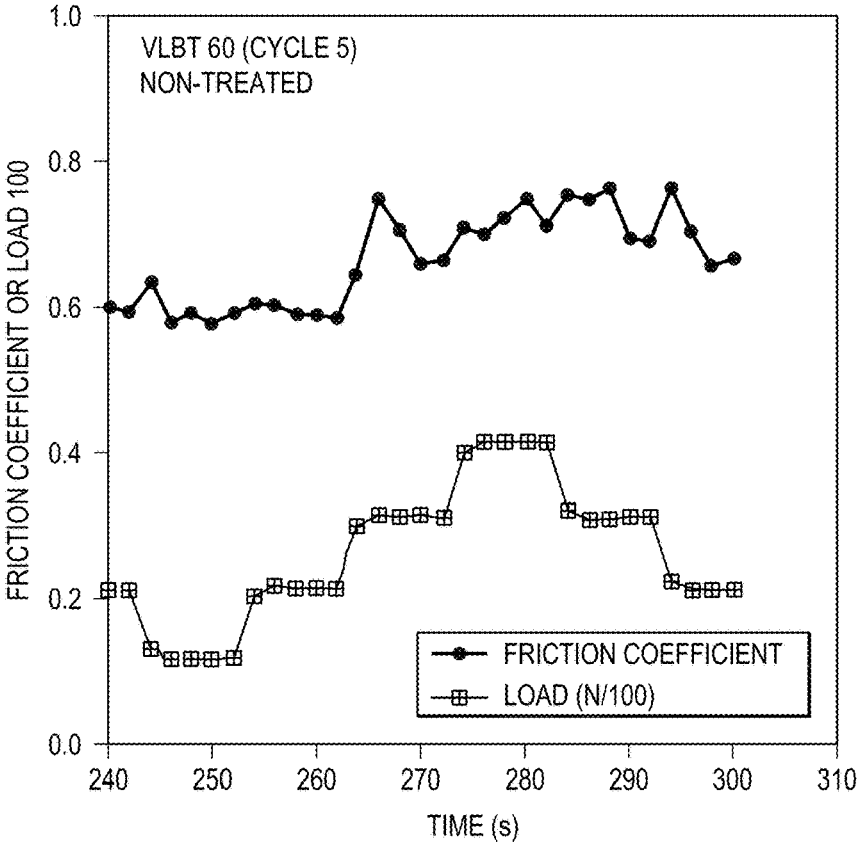
FIG. 2 is a graph of the fifth cycle load and friction coefficient for the non-treated pair.

FIG. 2 shows the last cycle of the same test. In comparison. FIG. 2 shows the fifth cycle load and friction coefficient for the non-treated pair. The friction is not as well correlated with the load after running-in.

Figure 3:
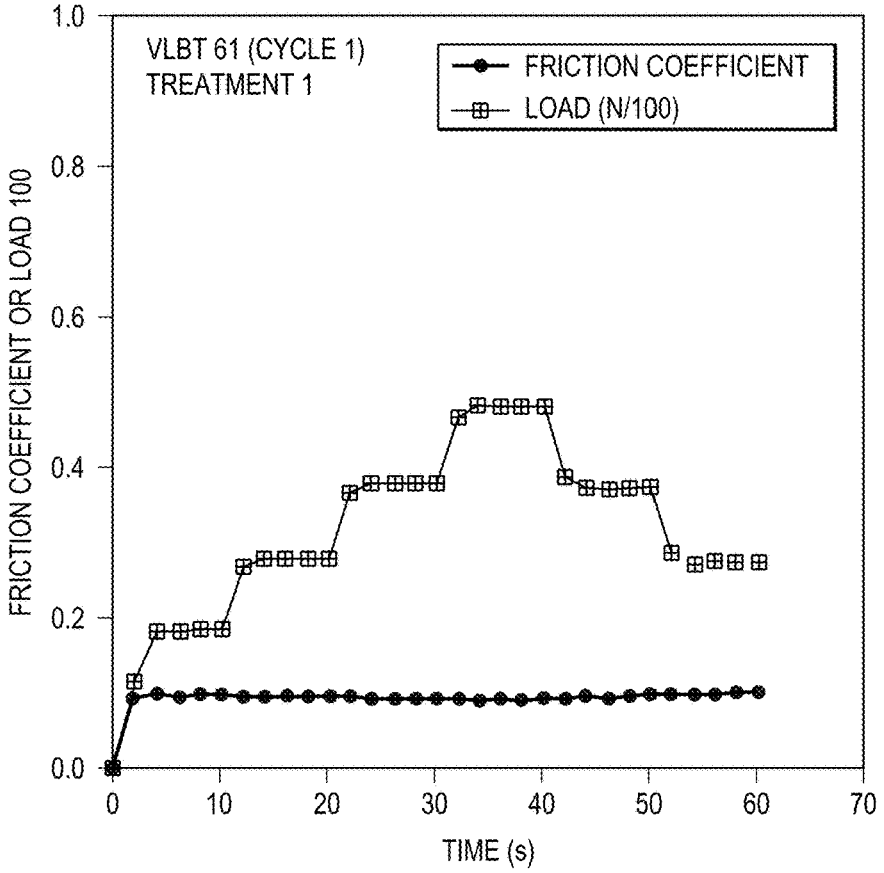
FIG. 3 is a graph of the first cycle load and friction coefficient for self-mated sample.

FIG. 3 shows the first cycle load and friction coefficient for self-mated Treatment 1. The friction coefficient does not follow the changes in load. FIG. 3 shows the first cycle of test VLBT-61 (both cylinder and flat specimen treated).

Figure 4:
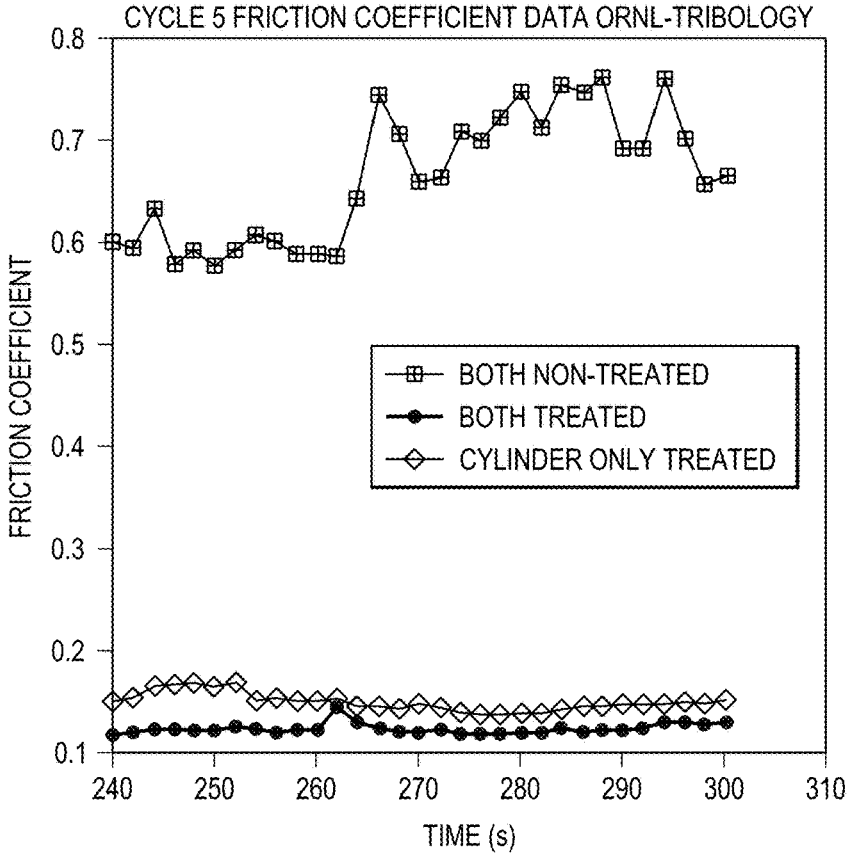
FIG. 4 is a comparison of friction versus time behavior of three conditions under the last cycle of a variable load friction test.

FIG. 4 shows the last cycle of the same test. Clearly, the treated pair was less sensitive to changes in normal force. FIG. 4 shows the friction versus testing time behavior for last cycle of the non-treated couple, the treated-on-treated couple, and the treated rod on non-treated flat specimen couple. Clearly, the non-treated steel surfaces had much higher friction coefficient than the treated ones, and the couple with both sides treated performed the best of all three.

Figure 5B:
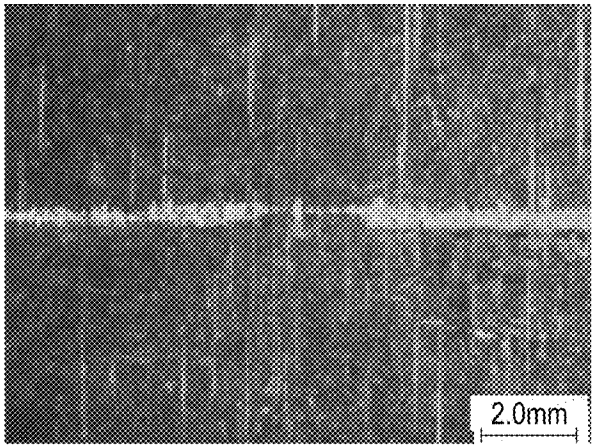
FIGS. 5A-5B and 6A-6B show the wear seen in the treated and untreated surface.
Figure 6B:
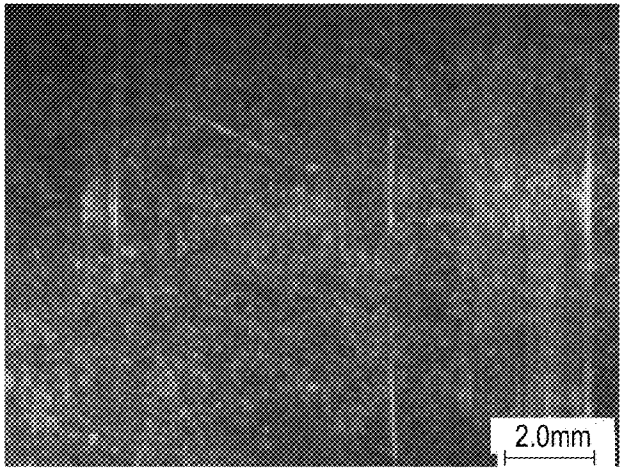
Figure 5A:
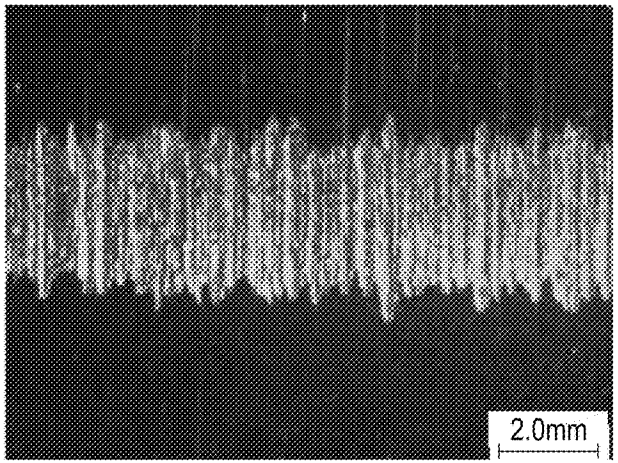
Figure 6A:
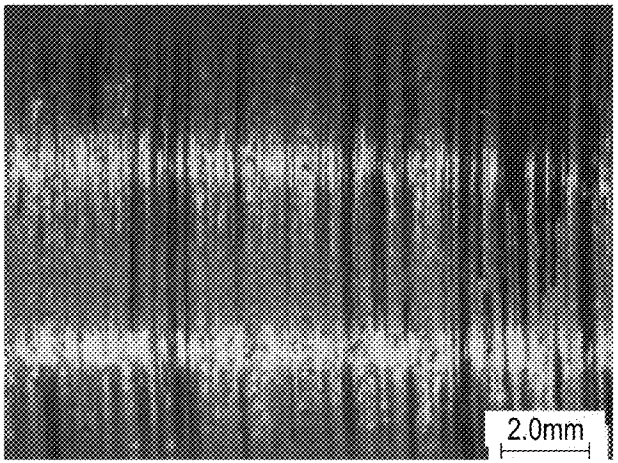

As the treatment is used to reduce the friction between the projectile and barrel it also reduces the wear on the barrel and increases the life of the barrel. FIGS. 5 and 6 show the wear seen in the treated and untreated surface. FIG. 5A is an image of an untreated surface in comparison to a treated surface FIG. 5B. FIG. 6A is an image of an untreated surface in comparison to a treated surface FIG. 6B. Comparison of flat specimens from two self-mated tests. There was very little wear on the treated specimens compared with that of the non-treated specimen combinations. The reduction in severe damage to both the flat specimens and the cylinder specimens is obvious. Scoring and adhesive wear dominate the non-treated specimen, while a smaller amount of abrasive wear occurs with the treated specimens. Of the treatments examined, the best wear results were when both surfaces were treated. When only one side was treated, there was definitely an advantage over non-treated, but there was also a greater chance of transition to scuffing or localized adhesion if a small spot happens to develop an open area or pick up a fragment of debris.

The treated surfaces and untreated surfaces were examined using thermal imaging. A high-speed infrared camera was positioned perpendicular to the axis of the cylinder and tilted down approximately 11 in order to view the cavity formed between the cylinder and the flat plate. The emissivity of the contact cavity between a cylinder and a flat plate has an emissivity approaching one due to the multiple reflections between their surfaces. This temperature was recorded during the variable load friction test for all three conditions; both surfaces non-treated, Cylinder only treated, and both surfaces treated.

Figure 7:
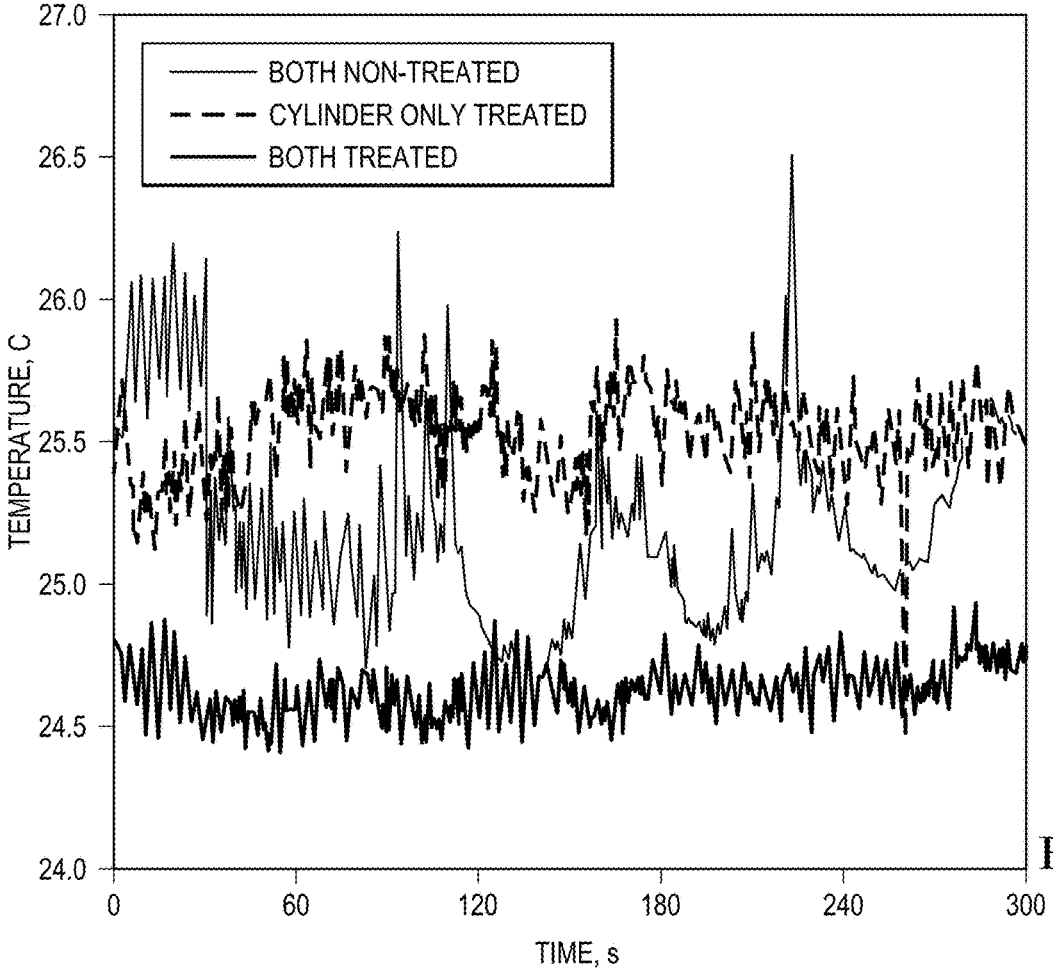
FIG. 7 shows a plot of the contact temperature as a function of time.

FIG. 7 shows a plot of the contact temperature as a function of time. Overall temperature variations during the tests were one degree or less due to the large heat-sink volume compared to the thin heat generating contact area. However, the load cycle is clearly indicated by a one degree temperature rise when both surfaces were non-treated. This load cycle is much less evident during the cylinder only treated test. In this case the variability of the contact temperature is lower and it is not clear when the load is applied. Under the test condition where both the cylinder and the flat plate are both treated, the contact temperature variability is greatly reduced and the overall temperature is lower than the cases where one or both of the surfaces are untreated.

Based on friction and wear tests of the treated materials, when applied to both sliding parts, the kinetic friction coefficient of the steel couples was reduced by more than 75%. In addition, the treatment of both mating parts produced a greater reduction in the kinetic friction coefficient. In addition, to a reduced friction the wear was significantly reduced. Similarly, the treatment reduced the temperature was reduced due to the reduced friction.

The present invention is a treatment for projectiles including bullets. The treatment is not a coating that is applied to the surface of the metal and is not intercalated into the metal, as shown by testing of the metal after treatment. To provide information of the changes to the metal after treatment the electron microscopy work performed on a treated saw blade. The electron micrographs were acquired on a field emission TEM, and energy-dispersive x-ray spectra were also acquired. Electron-transparent thin samples were prepared using the Hitachi FB-2000 focus-ion beam milling instrument (FIB). A small piece of the treated saw blade was sectioned and mounted in the FIB so that the surface of a sawtooth was normal to the incident gallium ion beam. To protect the surface of the sawtooth, a very thin glue layer was deposited just prior to insertion of the sample into the FIB. A tungsten overlayer was deposited over the glue layer, to further protect the surface during milling. A small slice about 15 microns×10 microns×4 microns thick was lifted out of the surface using an in-situ "microsampling" technique. This thin slice was mounted on the edge of a grid bar of a beryllium TEM grid, and the 4-micron-thick dimension was final milled to electron transparency (~50 nm).

Figure 8:
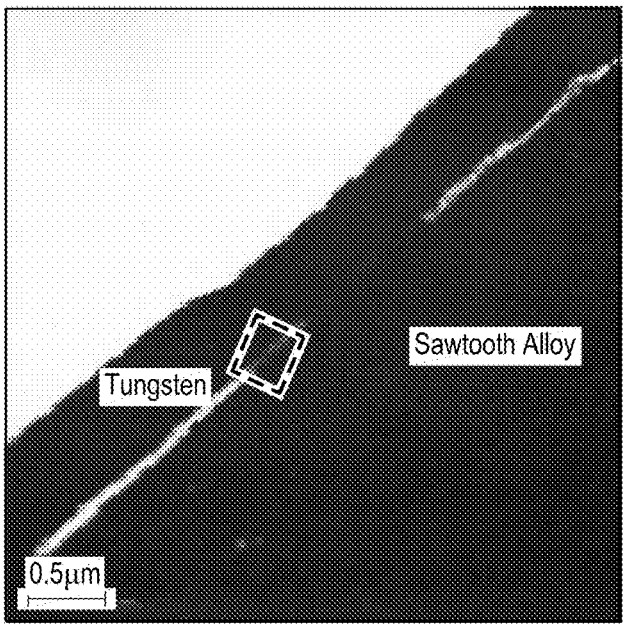
FIG. 8 shows a low magnification image of the cross section through the tungsten and glue overlayers, and into the sawtooth alloy.

FIG. 8 shows a low magnification image of the cross section through the tungsten and glue overlayers, and into the sawtooth alloy.

Figure 9:
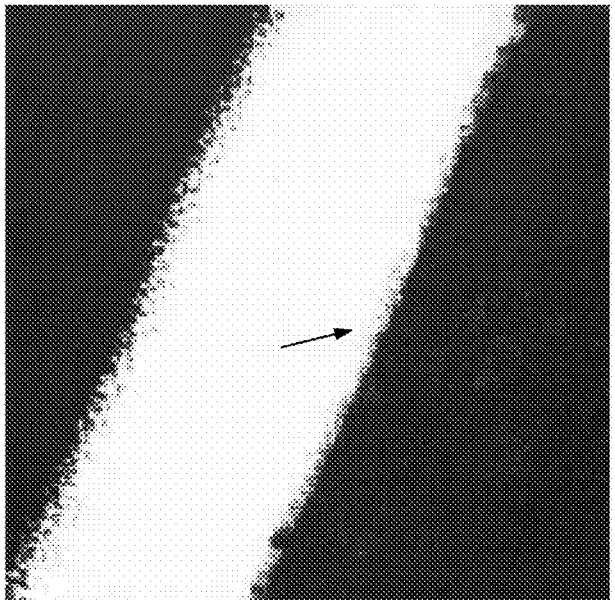
FIG. 9 is a higher magnification image of the boxed area is shown in FIG. 1.

FIG. 9 is a higher magnification image of the boxed area is shown in FIG. 1.

Figure 10:
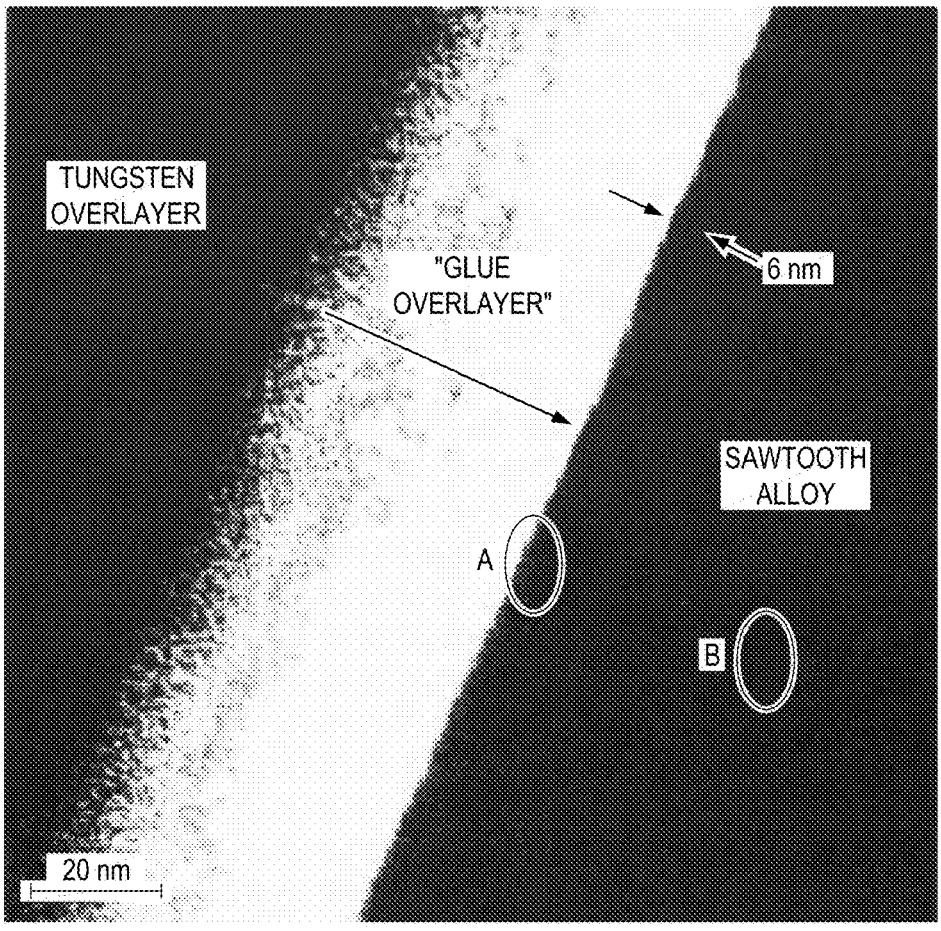
FIG. 10 is an annotated image of the image of the surface.
Figure 11:
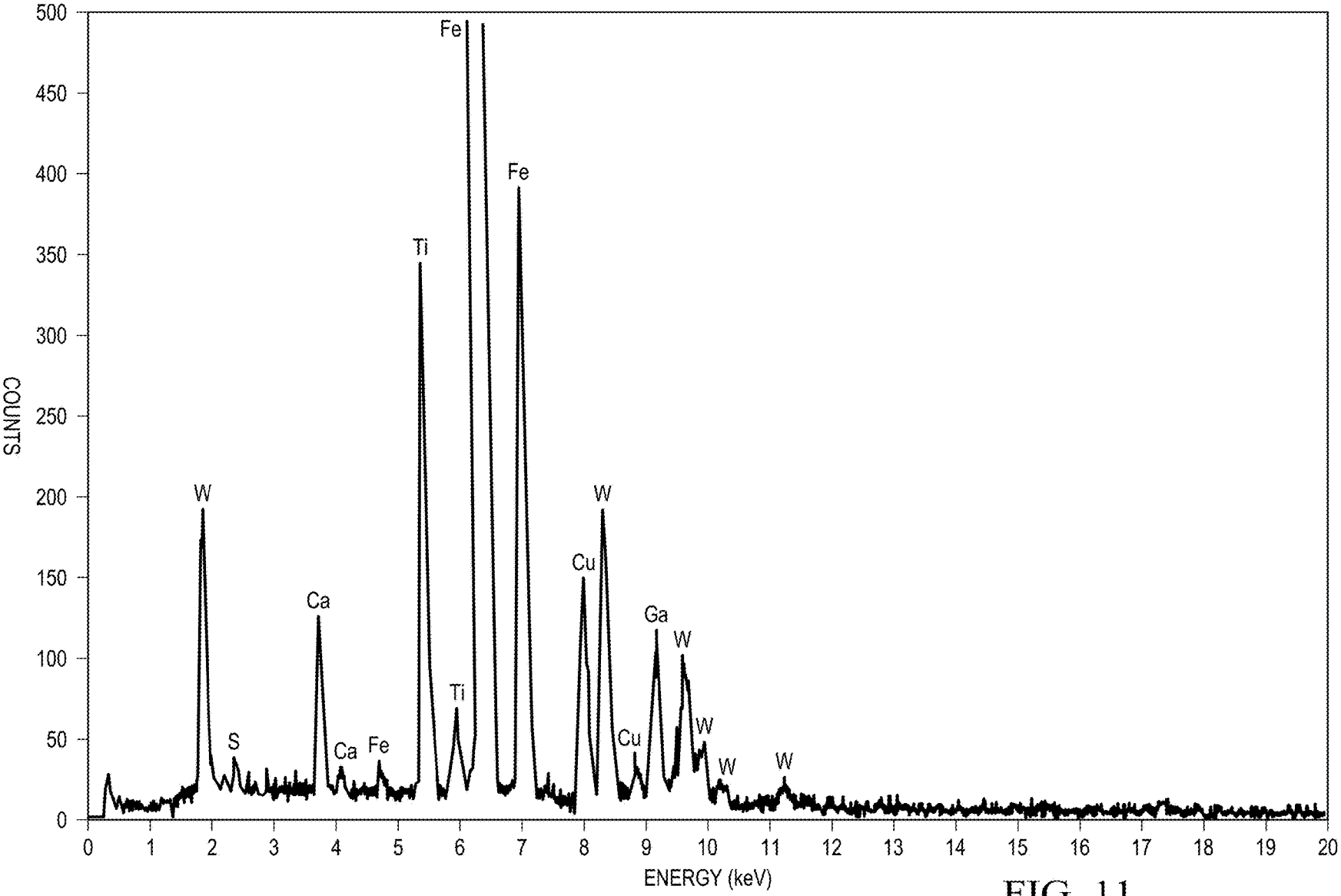
FIG. 11 is an EDS spectrum from the alloy in area A.
Figure 12:
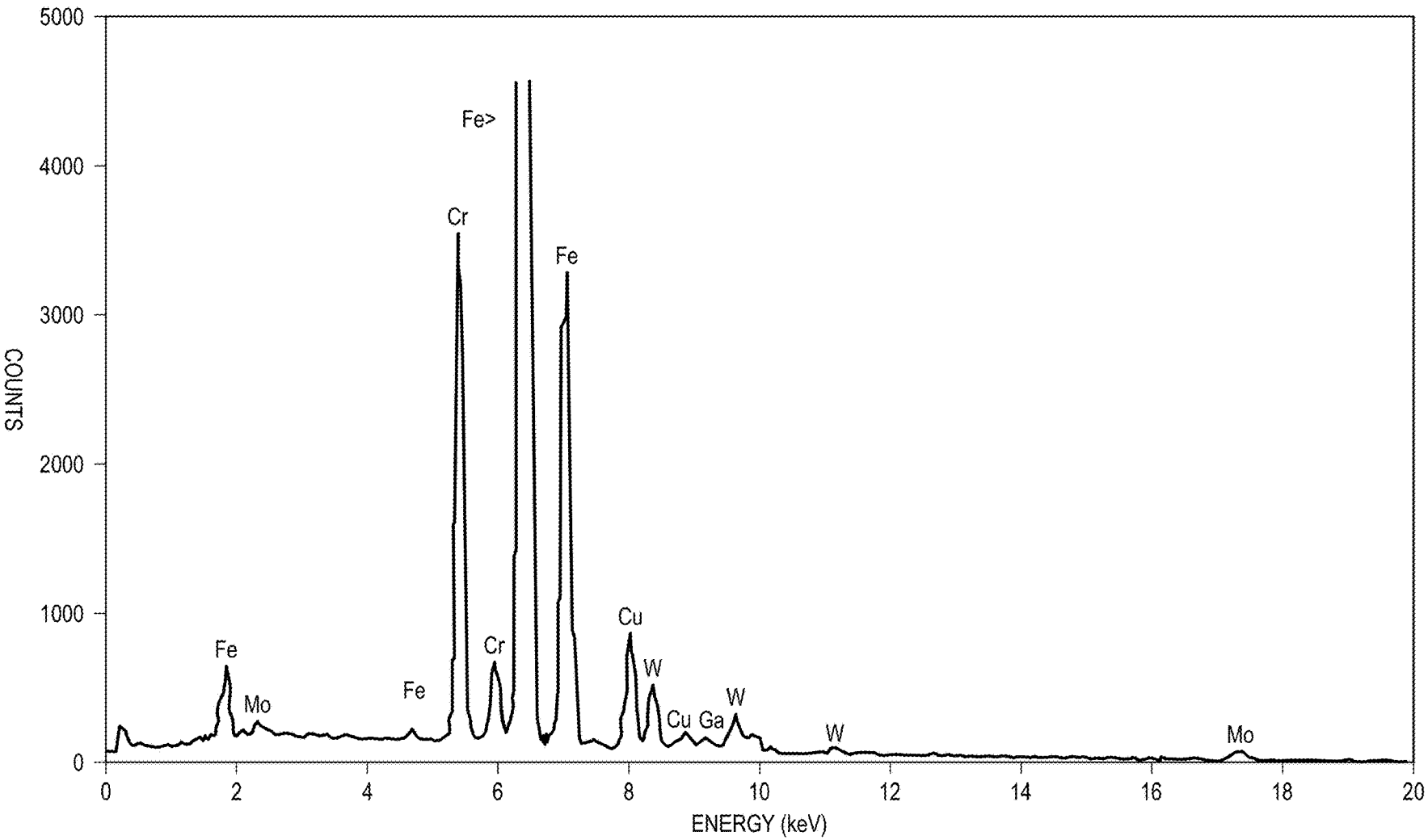
FIG. 12 is an EDS spectrum from the alloy in area B.

FIG. 10 is an annotated image of the image of the surface. There is a clear surface layer on the alloy, about 6 nm thick. An EOS spectra was taken from areas labeled A and B. The presence of calcium and sulfur associated with the surface layer is indicated by the peaks labeled in FIG. 11. FIG. 11 is an EDS spectrum from the alloy in area A. FIG. 12 is an EDS spectrum from the alloy in area B.

FIG. 11 shows an EDS spectrum from the 6 nm surface layer on the sagittal sawtooth and shows the presence of Ca and S in the layer. FIG. 12 shows an there is no Ca or S present in the alloy. No Ca is shown in the adjacent area B, from the base alloy. This Ca-rich surface layer is consistent with the Auger electron spectroscopy and x-ray photoelectron spectroscopy results obtained from the surface of the same sawtooth, and is associated with the chemical processing treatment of the present invention. Please note that the remaining peaks on the spectrum result from the alloy itself, or, in the case of W and Ga, from the focused ion beam milling procedure.

Figure 13A:
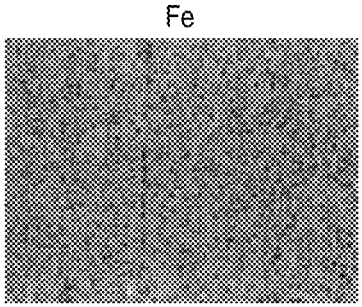
FIGS. 13A-13C are Auger elemental maps of the individual elements Fe, C and Ca respectively for the untreated surface.
Figure 13B:
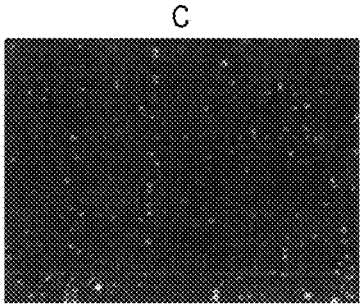
Figure 13C:
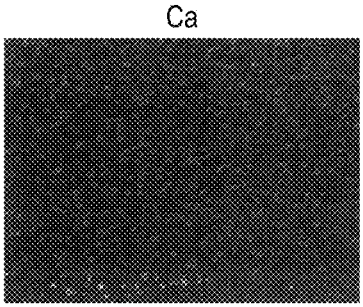
Figure 13D:
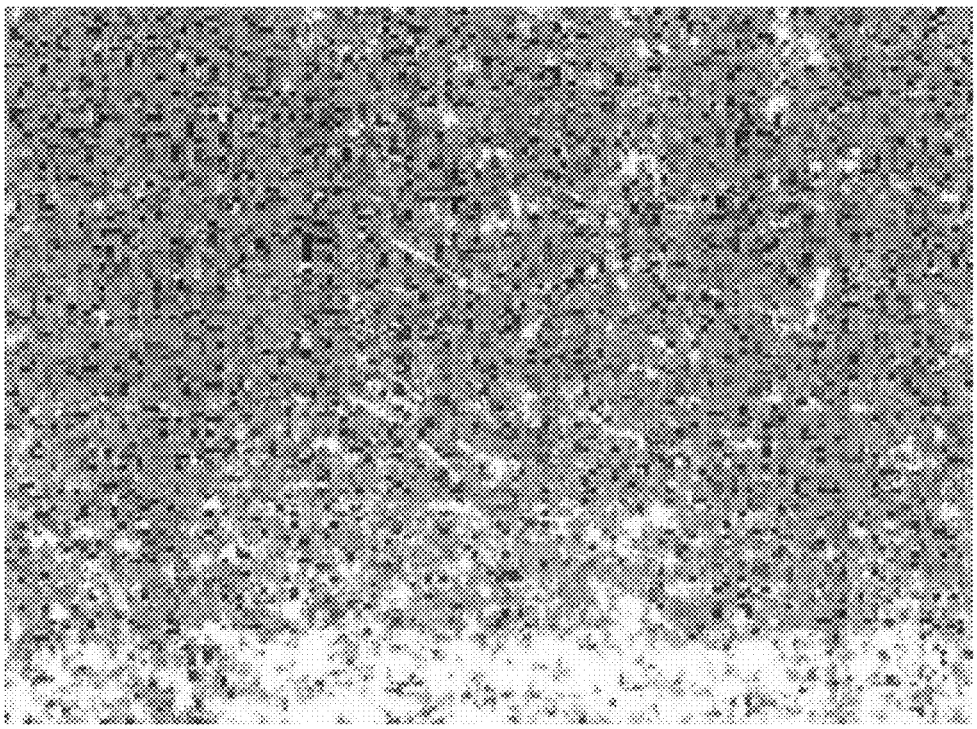
FIG. 13D is the combined image of elemental maps 13A-13C.
Figure 14A:
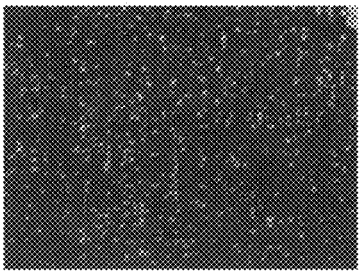
FIGS. 14A-14C are Auger elemental maps of the individual elements Fe, C and Ca respectively for the treated surface.
Figure 14B:
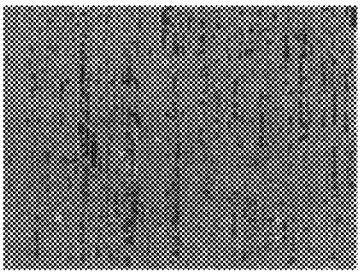
Figure 14C:
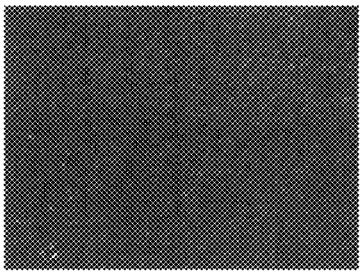
Figure 14D:
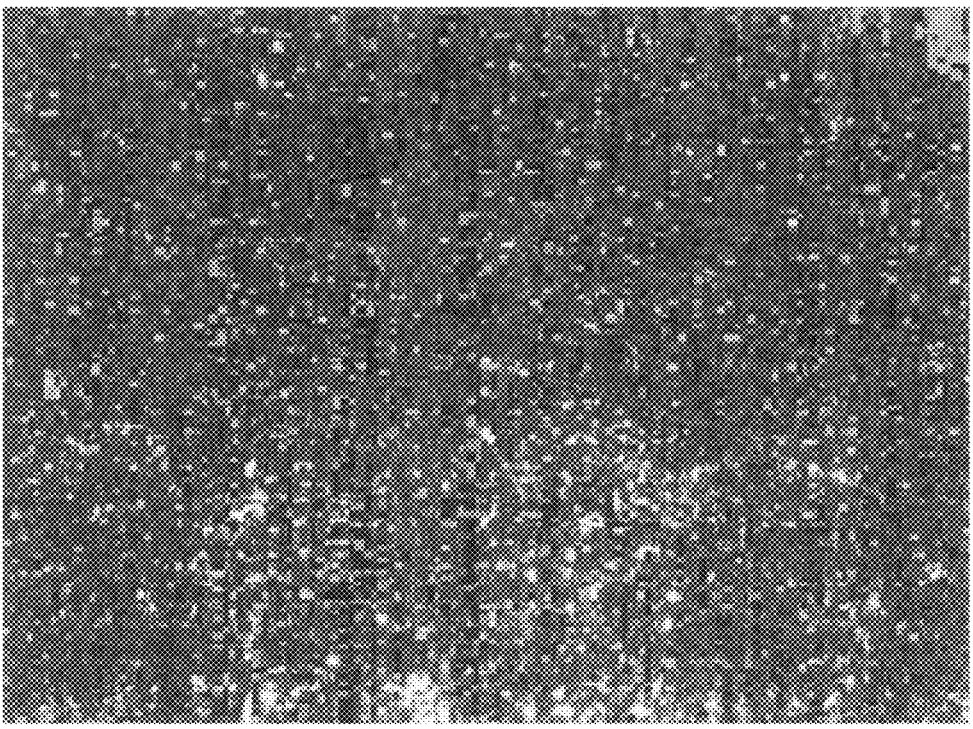
FIG. 14D is the combined image of elemental maps 14A-14C.

To further disclose the changes to the structure of the metal after treatment the metal was examined before and after treatment using Auger microanalysis (using Physical Electronics model Phi680 Scanning Auger Nanoprobe) because of its effectiveness in characterizing ultra-thin films. Briefly, Auger microanalysis involves the following. a beam of electron is accelerated to 10 kV and focused to a small spot (~250 Angstroms) and generates emitted electrons, known as Auger electrons, from the sample being examined. The kinetic energy of the emitted Auger electrons are measured and the spectrum of peaks that results is used to determine what elements are present and in what quantity. In addition to identifying elemental information, the incident electron beam also produces secondary electrons used to form images of the sample. The atomic concentration of the samples was determined by measuring the intensity of the peaks produced by each detected element. When the incident probe beam is scanned in two dimensions across the sample, a 2-D distribution of elements can be determined and displayed as an elemental map. FIGS. 13A-13C are Auger elemental maps of the individual elements Fe, C and Ca respectively for the untreated surface. FIG. 13D is the combined image of elemental maps 13A-13C. FIGS. 14A-14C are Auger elemental maps of the individual elements Fe, C and Ca respectively for the treated surface. FIG. 14D is the combined image of elemental maps 14A-14C. Untreated samples taken from the saw blades were analyzed. The major elements detected via Auger analysis included Fe, C, and O and a trace amount of Ca. (Note that this trace amount of Ca represents an upper limit determined by measuring the spectral noise). The sample was cleaned In-situ by briefly exposing the surface to energetic argon ions that lightly etch the sample by a process called sputtering. Auger elemental maps are shown for both the as-introduced surface and the sputtered surface. Oxygen and iron (most likely present as a form of Iron oxide) increase in intensity for the sputtered surface as carbon contamination (ubiquitous on most air-exposed metals surfaces) is removed. The results for the untreated saw blade are typical for air-exposed steel surfaces. The treated saw blade showed marked differences as compared to the untreated. Most notably was the presence of Ca and the increase in the amount of C. Similar sputter etching of the treated blade did not reduce the C nor Ca signals, indicating that they were present as an adherent film and not present as a surface adsorbed contaminant. Elemental 1 maps of the Ca, C, Fe, and O showed predominantly C and Ca covering the analysis area and weak Fe and O signals. This indicates that the Ca and e-rich film covers the "normal" iron oxide surface layer and attenuates the signals from Fe and O.

| Atomic Concentration Table | C (at %) | 0 (at %) | Ca (at %) | Fe (at %) |
|---|---|---|---|---|
| Untreated Saw Blade | | | | |
| Before Sputter Etching | 37.0 | 39.7 | 2.6 | 20.7 |
| After Sputter Etching | 5.8 | 61.9 | — | 32.3 |
| Treated Saw Blade | | | | |
| Before Sputter Etching | 64.9 | 12.5 | 20.6 | 2.0 |
| After Sputter Etching | 66.7 | 10.1 | 20.1 | 3.1 |

The present invention provides a treatment applied to any projectile regardless of any shape, size, caliber, grams, diameter, use, profile or any other property. The projectile of the present invention includes all shapes and calibers and is not limited to the specific embodiments disclosed herein. The treatment of the present invention may be performed on various small and medium caliber munitions, including 5.56 mm, 7.62 mm, 308, 338, 3030, 3006, and .50 caliber ammunition cartridges, as well as ammunition such as 380 caliber, 38 caliber, 40 caliber, 45 caliber, 9 mm, 10 mm and military style ammunition including 12.7 mm, 14.5 mm, 14.7 mm, 20 mm, 25 mm, 30 mm, 40 mm, 57 mm, 60 mm, 75 mm, 76 mm, 81 mm, 90 mm, 100 mm, 105 mm, 106 mm, 115 mm, 120 mm, 122 mm, 125 mm, 130 mm, 152 mm, 155 mm, 165 mm, 175 mm, 203 mm, 460 mm, 8 inch, 4.2 inch, 45 caliber and the like. Thus, the present invention is also applicable to the sporting goods industry for use by hunters and target shooters as well as military use.

The treatment of the present invention may be performed on a projectile 50 of any profile but generally has an aerodynamic streamlined shape at the head and at the tail, e.g., spritzer, flat base spritzer, boat tail spritzer, tapered-heel spritzer, rounded nose, rounded nose flat base, rounded nose boat tail, rounded nose tapered-heel, flat nose, flat nose flat base, flat nose boat tail, flat nose tapered-heel, hollow point, hollow point boat tail, hollow point flat base, hollow point tapered-heel and so on. Although any head shape can be used, more common shapes include spritzer shape, round, conical, frustoconical, blunted, wadcutter, or hollow point, and the more common tail shape includes flat base, boat tail, tapered-heel expanded bases or banded bases. The treatment of the bullets of the present invention are not limited to any profile and weight dictated by the particular application. For example, the treatment of the present invention may be used in full metal jacket metal cased and full metal jacket both refer to bullets with a metal coating that covers all of, or all but the base of a bullet; metal cased (e.g., as used by REMINGTON® to refer to their full metal jacketed bullets); hollow point bullets have a concave shaped tip that facilitates rapid expansion of the round upon impact; boat tail bullets have a streamlined base to facilitate better aerodynamics; boat tail hollow point; full metal jacketed boat tail; point jacketed hollow point bullets are similar in design to regular hollow point bullets, but have a copper jacket that normally covers everything but the hollowed portion of the round; jacketed flat point rounds have a flat area of exposed lead at the tip; jacketed soft point bullets usually have a spire pointed tip of exposed lead. Jacketed spitzer point can refer to a jacketed spitzer point; spitzer meaning a sharply pointed bullet; jacketed round nose jacketed round nose bullets split the difference between jacketed flat point and jacketed spitzer point bullets and have a rounded tip of exposed lead boat tail soft point sometimes the letters in the acronyms are switched, so boattail soft point may also be abbreviated as soft point boattail. Expanding full metal jacketed rounds appear as and feed like a regular full metal jacket bullet, but have a construction that allows the case to collapse and the bullet to flatten upon impact. Wad cutter designs often appear to be nothing more than a cylinder, usually with a hollow base which is used in target practice to punch neat holes in the paper, rather than the ragged holes produced by more rounded designs. Semi wad cutter bullets have a rounded nose that comes down to a cylinder that is slightly larger than the rounded section, giving the bullet a more aerodynamic shape while allowing it to punch clean holes in paper targets. Rounded flat point bullets have a flat tip that is smaller than the bullet diameter and rounded shoulders. Armor piercing ammunition can have bullets with a variety of shapes, though in general they are spire pointed and full metal jacketed rounds that have a strong core designed to penetrate armor. Armor piercing incendiary ammunition has the same penetrating abilities of armor piercing bullets, but with the added function of bursting into an intense flame upon impact. Frangible ammunition is available under a number of trademarks; notably MAGSAFE®, GLASER®, and SINTERFIRE® and are characterized by a design that facilitates the rapid breakup of the bullet upon impact, thus, reducing the chances of over-penetration or a ricochet. Exploding ammunition includes delayed and aerial/above ground exploding ammunition plus ammunition that can penetrate an objective and have a delay before exploding after penetrating. Also included are jacketed designs where the core material is a very hard, high-density metal such as tungsten, tungsten carbide, depleted uranium, or steel. The treatment of the present invention may be performed on any of these projectiles.

Figure 15:
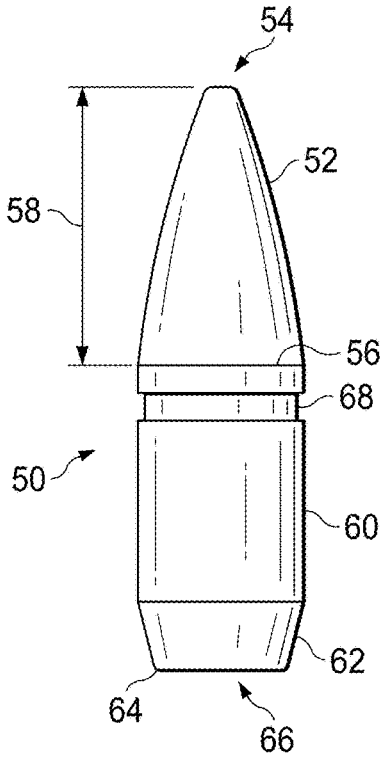
FIG. 15 is an image of a flat tip boattail projectile.

FIG. 15 is an image of a flat nose boattail projectile with the treatment of the present invention. The projectile 50 includes an ogive 52 that extends from the nose 54 (flat tip) to the shoulder 56. The distance from the nose 54 to the shoulder 56 is the head or ogive distance 58, with the distance from the shoulder 56 extending away from the nose 54 is the bearing surface 60. The bearing surface 60 may be extended with a boattail 62, which tappers to heal 64 that curves to form a base 66. An optional cannelure 68 may be positioned on the bearing surface 60 below the shoulder 56.

Figure 16:
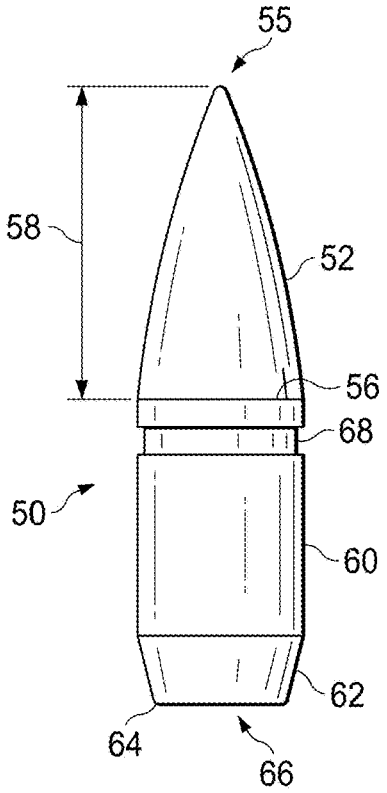
FIG. 16 is an image of a full metal jacket, expanding full metal jacket, spritzer, jacketed spritzer, armor piercing, armor piercing incendiary or a similar projectile having a pointed nose and a boattail configured end.

FIG. 16 is an image of an full metal jacket, expanding full metal jacket, spritzer, jacketed spritzer, armor piercing, armor piercing incendiary or a similar projectile 50 having a pointed nose 55 and a boattail 62 with the treatment of the present invention. The ogive 52 extends from the nose 55 (pointed tip) to the shoulder 56. The distance from the pointed nose 55 to the shoulder 56 is the head or ogive distance 58, with the distance from the shoulder 56 extending away from the pointed nose 55 is the bearing surface 60. The bearing surface 60 may be extended with a boattail 62, which tappers to heal 64 that curves to form a base 66. An optional cannelure 68 may be positioned on the bearing surface 60 below the shoulder 56.

Figure 17:
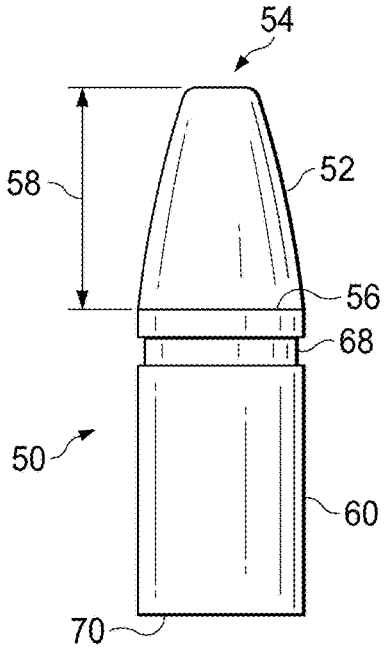
FIG. 17 is an image of a flat tip projectile with a flat base configured end.

FIG. 17 is an image of a flat nose flat base projectile with the treatment of the present invention. The projectile 50 includes an ogive 52 that extends from the nose 54 (flat tip) to the shoulder 56. The distance from the nose 54 to the shoulder 56 is the head or ogive distance 58, with the distance from the shoulder 56 extending away from the nose 54 is the bearing surface 60. The bearing surface 60 ends with a flat base 70. An optional cannelure 68 may be positioned on the bearing surface 60 below the shoulder 56.

Figure 18:
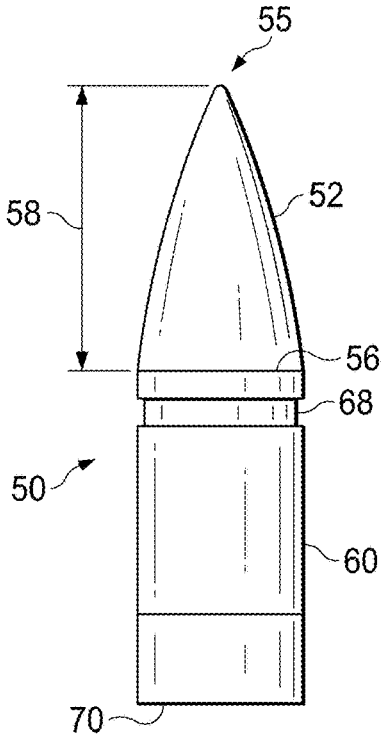
FIG. 18 is an image of a full metal jacket, expanding full metal jacket, spritzer, jacketed spritzer, armor piercing, armor piercing incendiary or a similar projectile having a pointed nose and a flat base configured end.

FIG. 18 is an image of an full metal jacket, expanding full metal jacket, spritzer, jacketed spritzer, armor piercing, armor piercing incendiary or a similar projectile 50 having a pointed nose 55 and a flat base 70 with the treatment of the present invention. The ogive 52 extends from the pointed nose 55 (pointed tip) to the shoulder 56. The distance from the pointed nose 55 to the shoulder 56 is the head or ogive distance 58, with the distance from the shoulder 56 extending away from the pointed nose 55 is the bearing surface 60. The bearing surface 60 ends with a flat base 70. An optional cannelure 68 may be positioned on the bearing surface 60 below the shoulder 56.

Figure 19:
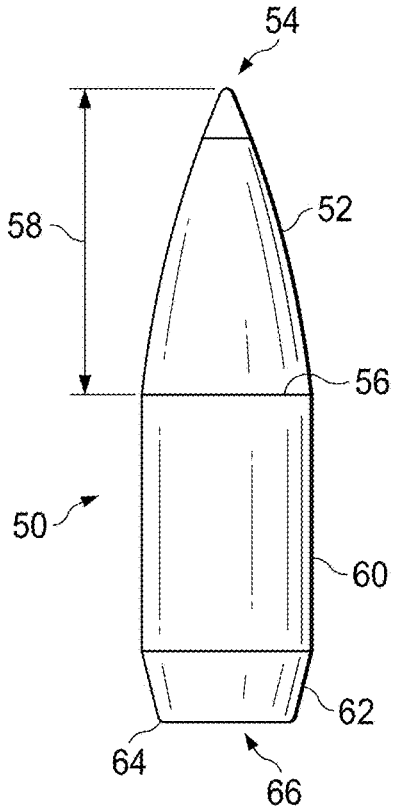
FIG. 19 is an image of a boattail configured end projectile without a cannelure.

FIG. 19 is an image of a boattail projectile without a cannelure with the treatment of the present invention. The projectile 50 includes an ogive 52 that extends from the nose 54 to the shoulder 56. The distance from the nose 54 (blunt or pointed (not shown)) to the shoulder 56 is the head or ogive distance 58, with the distance from the shoulder 56 extending away from the nose 54 is the bearing surface 60. The bearing surface 60 may be extended with a boattail 62, which tappers to heal 64 that curves to form a base 66.

Figure 20:
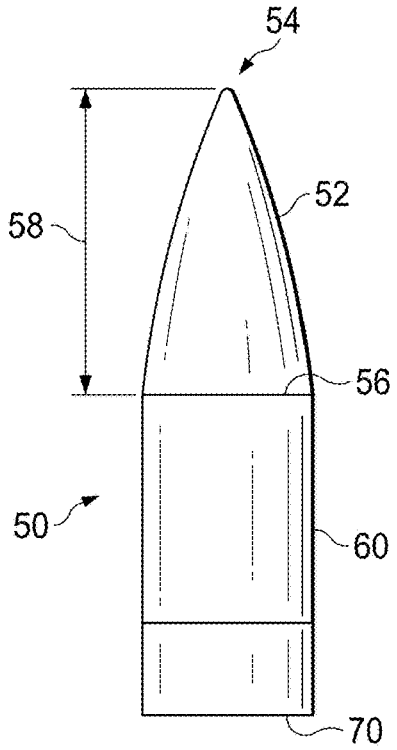
FIG. 20 is an image of a flat base configured end projectile without a cannelure.

FIG. 20 is an image of a flat base projectile without a cannelure with the treatment of the present invention. The ogive 52 extends from the nose 54 (blunt or pointed (not shown)) to the shoulder 56. The distance from the nose 54 to the shoulder 56 is the head or ogive distance 58, with the distance from the shoulder 56 extending away from the nose 54 is the bearing surface 60. The bearing surface 60 may be extended to flat base 70.

Figure 21:
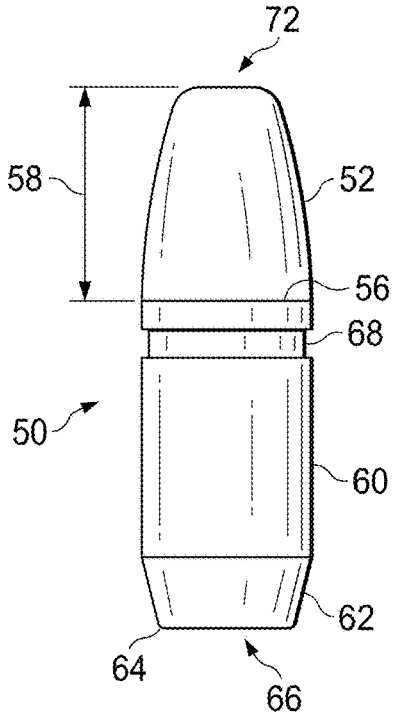
FIG. 21 is an image of a boattail configured end projectile with rounded nose.

FIG. 21 is an image of a boattail projectile 50 with rounded nose with the treatment of the present invention. The projectile 50 includes an ogive 52 that extends from the rounded nose 72 to the shoulder 56. The distance from the rounded nose 72 to the shoulder 56 is the head or ogive distance 58, with the distance from the shoulder 56 extending away from the nose 72 is the bearing surface 60. The bearing surface 60 may be extended with a boattail 62, which tappers to heal 64 that curves to form a base 66. An optional cannelure 68 may be positioned on the bearing surface 60 below the shoulder 56.

Figure 22:
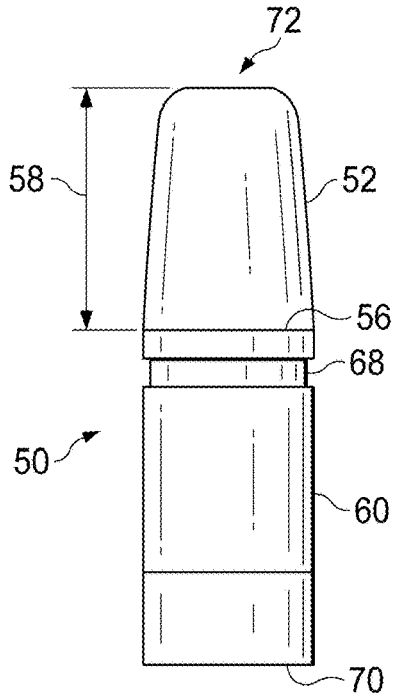
FIG. 22 is an image of a flat base projectile with a rounded nose.

FIG. 22 is an image of a flat base projectile 50 with a rounded nose 72 with the treatment of the present invention. The ogive 52 extends from the rounded nose 72 to the shoulder 56. The distance from the rounded nose 72 to the shoulder 56 is the head or ogive distance 58, with the distance from the shoulder 56 extending away from the rounded nose 72 is the bearing surface 60. The bearing surface 60 may be extended to flat base 70. An optional cannelure 68 may be positioned on the bearing surface 60 below the shoulder 56.

Figure 23:
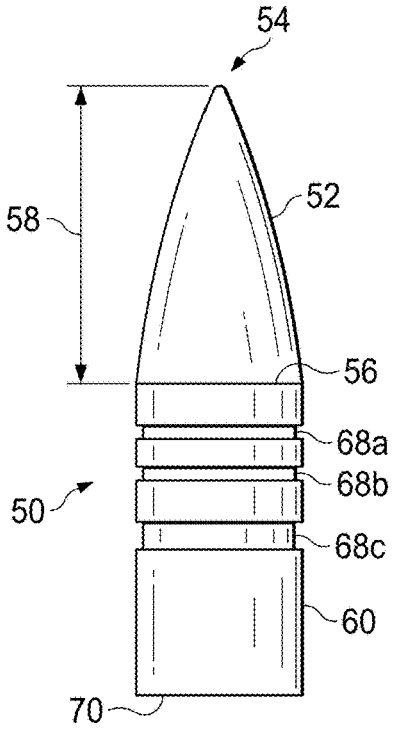
FIG. 23 is an image of a flat base configured end projectile having multiple cannelures.

FIG. 23 is an image of a flat base projectile 50 having multiple cannelures 68*a*, 68*b*, 68*c* with the treatment of the present invention. The ogive 52 extends from the nose 54 to the shoulder 56. The distance from the nose 54 to the shoulder 56 is the head or ogive distance 58, with the distance from the shoulder 56 extending away from the nose 54 is the bearing surface 60. The bearing surface 60 terminates in a flat base 70. The cannelures 68*a*-68*c* may be positioned on the bearing surface 60 below the shoulder 56. Although 1 and 3 cannelures 68*a*-68*c* are shown as representative examples, any number of cannelures may be used, e.g., 1, 2, 3, 4, 5, 6, 7, 8, 9, 10 or more cannelures having various thicknesses and depths.

Figure 24:
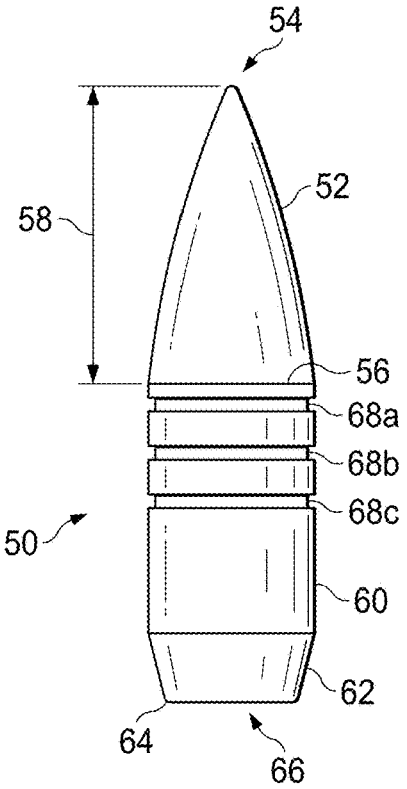
FIG. 24 is an image of a boattail configured end projectile having multiple cannelures.

FIG. 24 is an image of a boattail projectile 50 having multiple cannelures 68*a*-68*c* with the treatment of the present invention. The projectile 50 includes an ogive 52 that extends from the nose 54 to the shoulder 56. The distance from the nose 54 to the shoulder 56 is the head or ogive distance 58, with the distance from the shoulder 56 extending away from the nose 54 is the bearing surface 60. The bearing surface 60 may be extended with a boattail 62, which tappers to heal 64 that curves to form a base 66. Although 1 and 3 cannelures 68*a*-68*c* are shown as representative examples, any number of cannelures may be used, e.g., 1, 2, 3, 4, 5, 6, 7, 8, 9, 10 or more cannelures having various thicknesses and depths.

Figure 25:
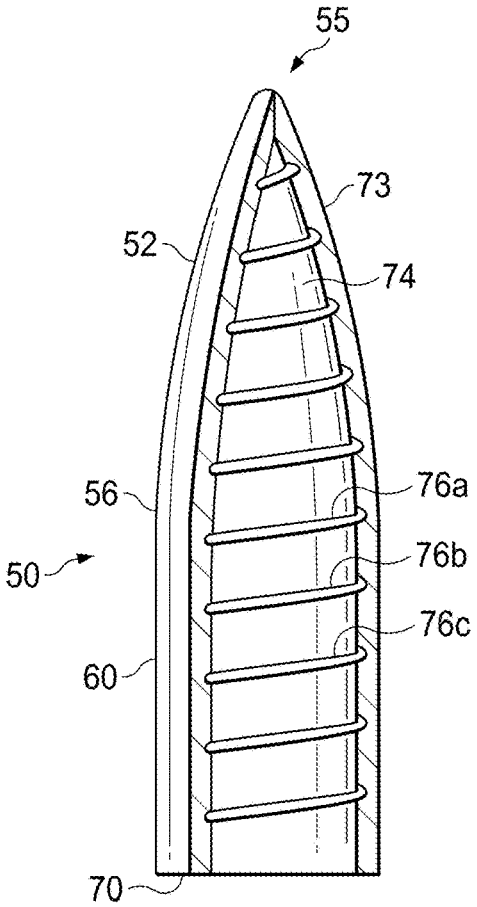
FIG. 25 is a cut away image of a jacketed spritzer projectile.

FIG. 25 is a cut away image of a jacketed spritzer projectile with the treatment of the present invention. The projectile 50 includes a nose 55 that extends to a shoulder 56. A bearing surface 60 extends from the shoulder 56 to the base 70. The outer surface 73 of the projectile 50 is a metal jacket covering a metal core 74 that includes a spiral ridge 76*a*, 76*b* and 76*c* (alternatively it may be a spiral groove). In addition, at least a portion of the ogive 52 of the outer surface 73 may be of a softer metal to allow deformation at impact allowing the metal core 74 to penetrate the target.

Figure 26:
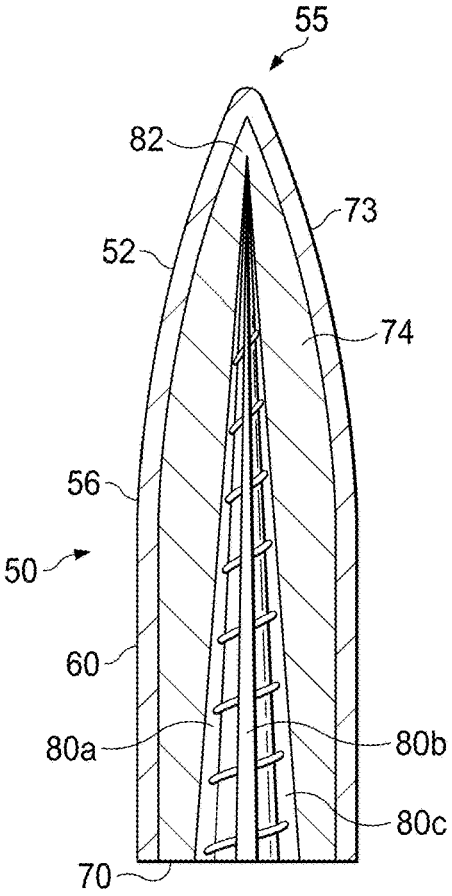
FIGS. 26-31 are cut away images of a jacketed projectile.

FIG. 26 is a cut away image of a jacketed projectile with the treatment of the present invention. The projectile 50 includes a nose 55 that extends to a shoulder 56. A bearing surface 60 extends from the shoulder 56 to the base 70. The outer surface 73 of the projectile 50 is a metal jacket covering a metal core 74 that encompasses a central projectile 78 having ridges or fins 80*a*, 80*b* and 80*c* that terminate at a tip 82 (alternatively the central projectile 78 may have spiral grooves or ridges). In addition, at least a portion of the ogive 52 of the outer surface 73 may be of a softer metal to allow deformation at impact allowing the metal core 74 to penetrate the target.

Figure 27:
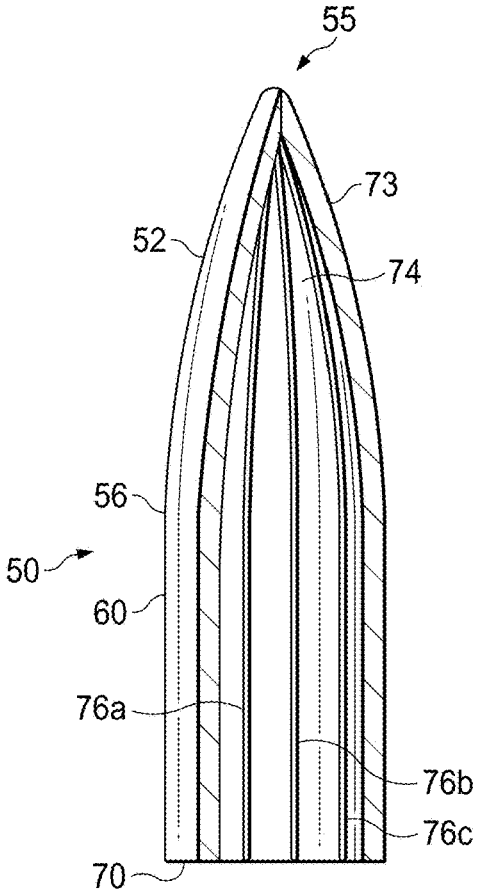

FIG. 27 is a cut away image of a jacketed projectile with the treatment of the present invention. The projectile 50 includes a nose 55 that extends to a shoulder 56. A bearing surface 60 extends from the shoulder 56 to the base 70. The outer surface 73 of the projectile 50 is a metal jacket covering a metal core 74 that includes longitudinal ridges 76*a*, 76*b* and 76*c* (alternatively it may be longitudinal grooves). In addition, at least a portion of the ogive 52 of the outer surface 73 may be of a softer metal to allow deformation at impact allowing the metal core 74 to penetrate the target.

Figure 28:
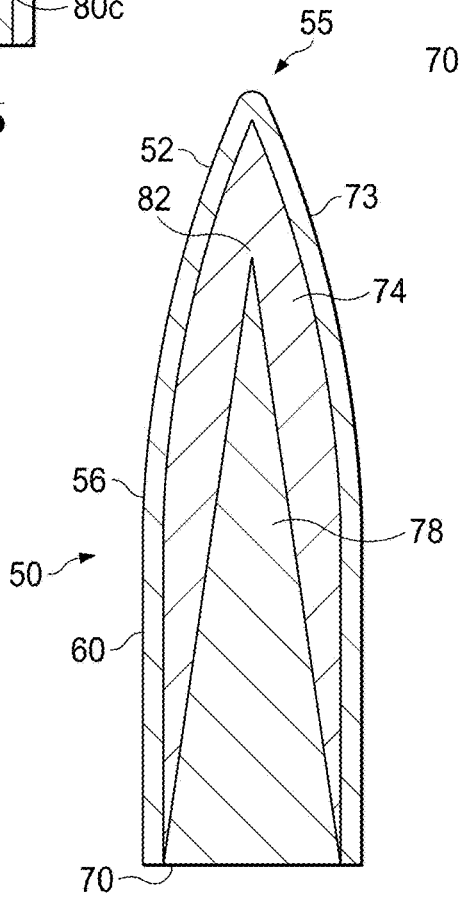

FIG. 28 is a cut away image of a jacketed projectile with the treatment of the present invention. The projectile 50 includes a nose 55 that extends to a shoulder 56. A bearing surface 60 extends from the shoulder 56 to the base 70. The outer surface 73 of the projectile 50 is a jacket covering a metal core 74 that encompasses a central projectile 78 that terminate at a tip 82. In addition, at least a portion of the ogive 52 of the outer surface 73 may be of a softer metal to allow deformation at impact allowing the metal core 74 to penetrate the target.

Figure 29:
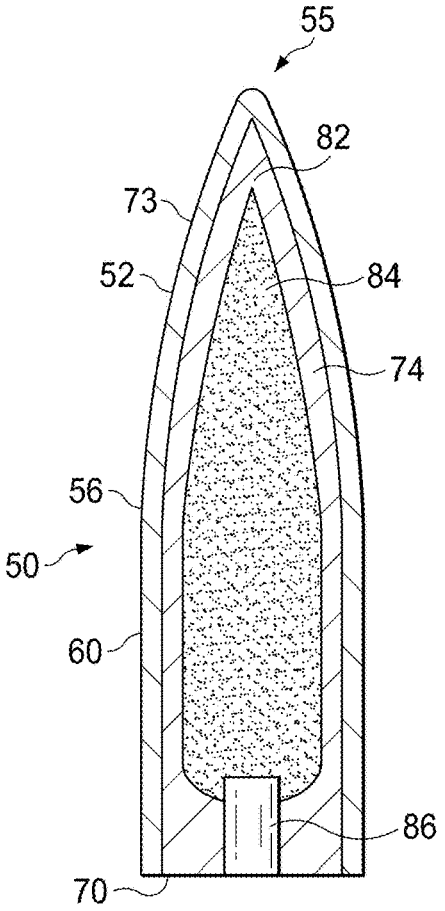

FIG. 29 is a cut away image of a jacketed projectile with the treatment of the present invention. The projectile 50 includes a nose 55 that extends to a shoulder 56. A bearing surface 60 extends from the shoulder 56 to the base 70. The outer surface 73 of the projectile 50 is a jacket covering a metal core 74 that encompasses a central region 84 that terminate at a tip 82. The central region 84 may contain a flammable composition that is ignited by ignition source 86.

Figure 30:
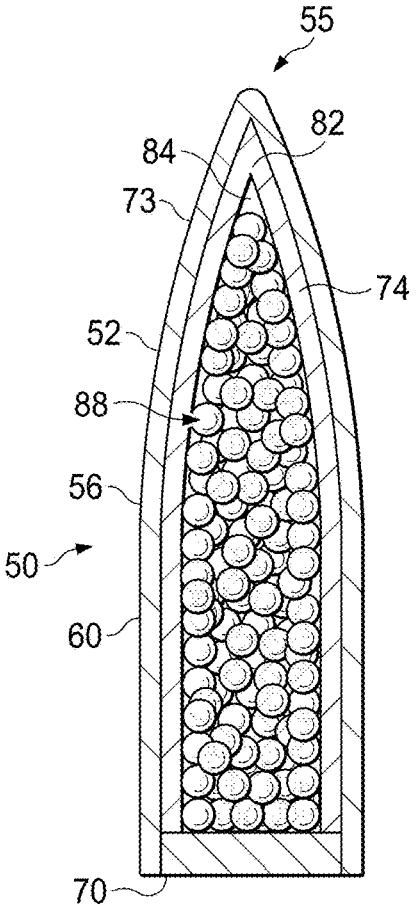

FIG. 30 is a cut away image of a jacketed projectile with the treatment of the present invention. The projectile 50 includes a nose 55 that extends to a shoulder 56. A bearing surface 60 extends from the shoulder 56 to the base 70. The outer surface 73 of the projectile 50 is a jacket covering a metal core 74 that encompasses a central region 84 that terminate at a tip 82. The central region 84 may contain pelleted materials 88 that may be ejected upon impact. In addition, at least a portion of the ogive 52 of the outer surface 73 may be of a softer metal to allow deformation at impact allowing more efficient ejection of the pelleted materials 88.

Figure 31:
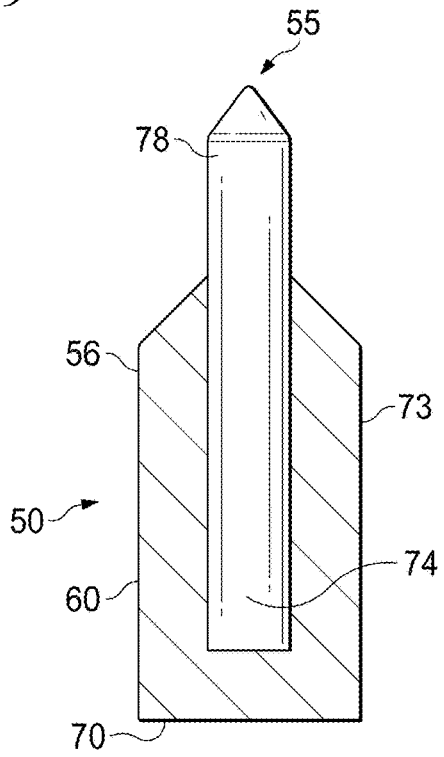

FIG. 31 is a cut away image of a jacketed projectile with the treatment of the present invention. The projectile 50 includes a nose 55 that extends to a shoulder 56. A bearing surface 60 extends from the shoulder 56 to the base 70. The outer surface 73 of the projectile 50 partially covers a central projectile 78 to allow the central projectile 78 to penetrate the target.

Figure 32A:
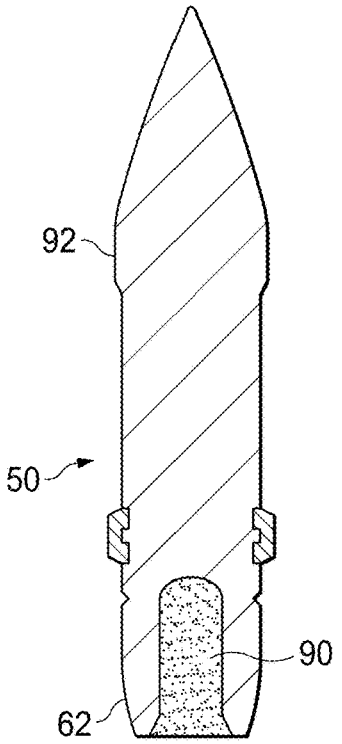
FIGS. 32A-32S are cut away images of different projectile types.
Figure 32B:
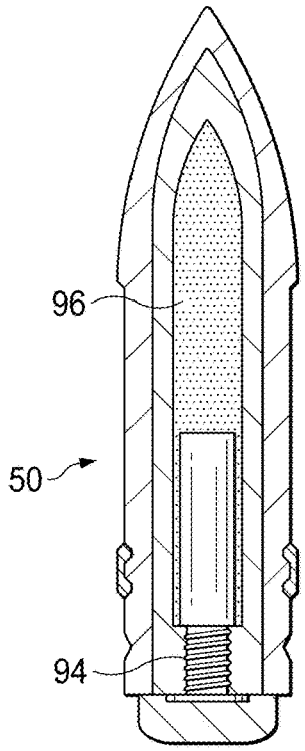
Figure 32C:
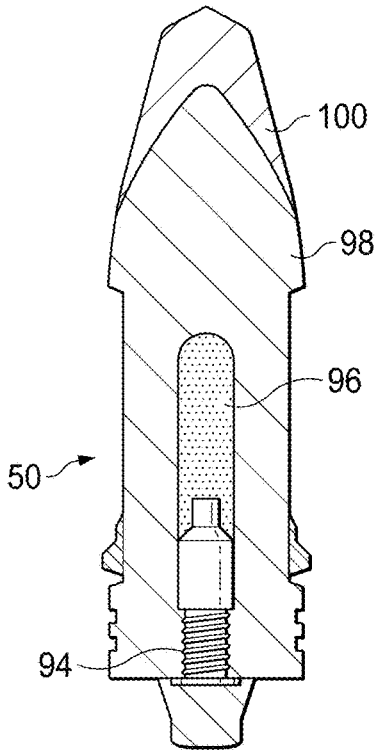
Figure 32D:
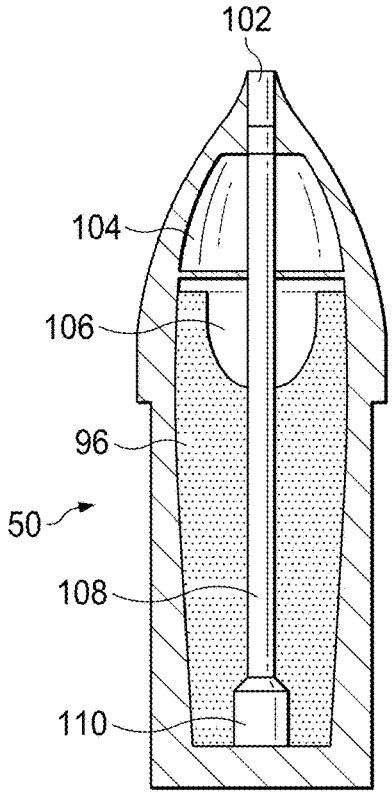
Figure 32E:
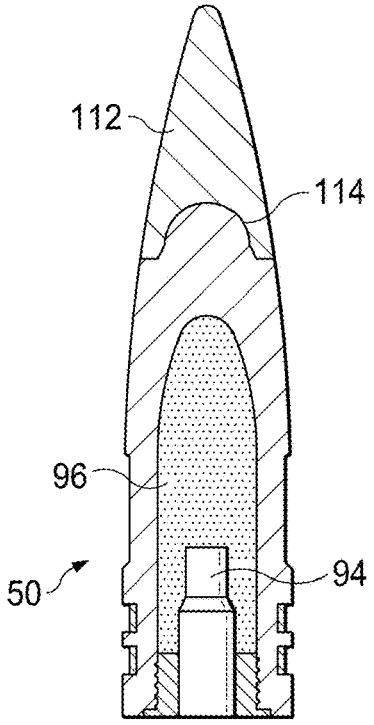
Figure 32F:
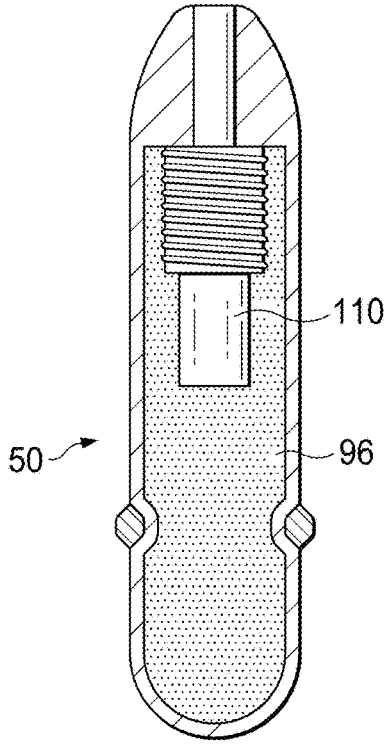
Figure 32G:
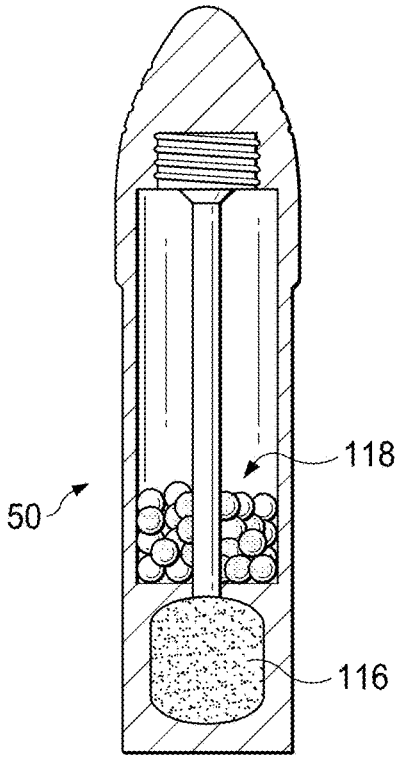
Figure 32H:
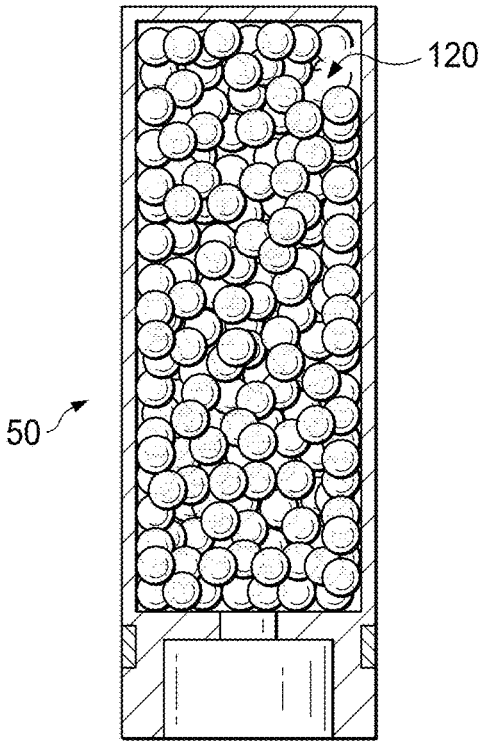
Figure 32I:
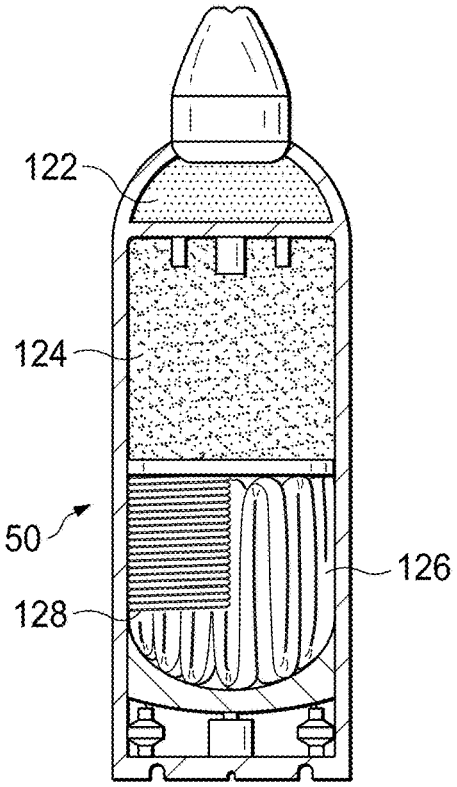
Figure 32J:
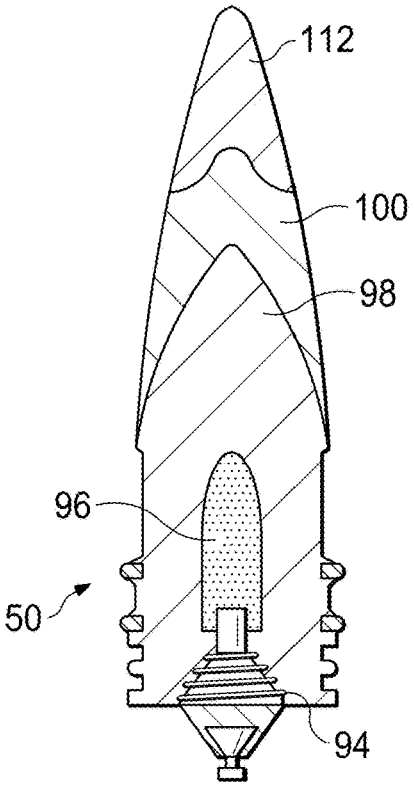
Figure 32K:
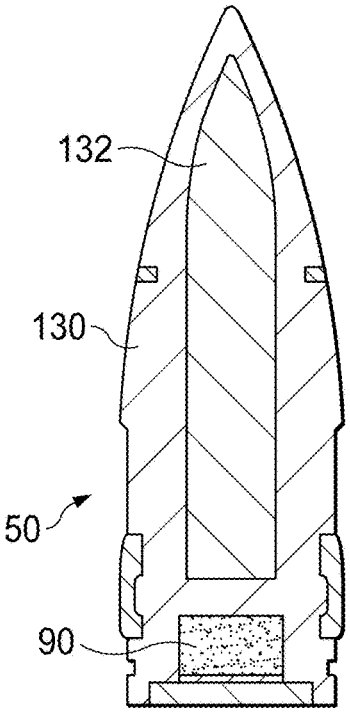
Figure 32L:
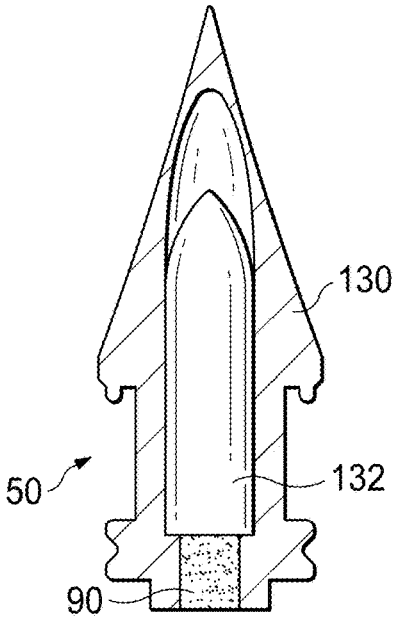
Figure 32M:
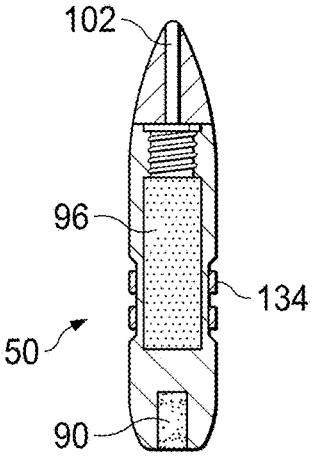
Figure 32N:
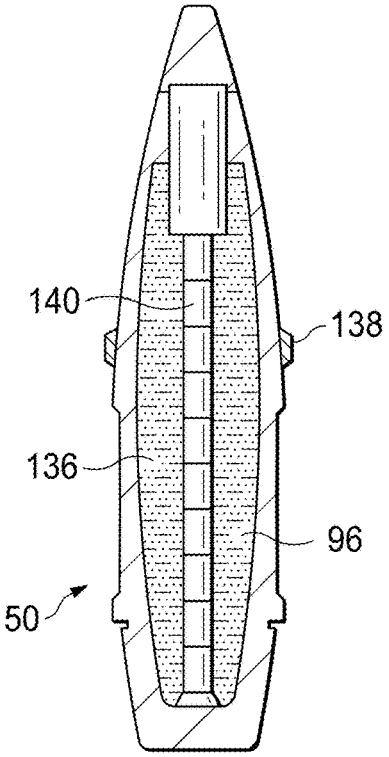
Figure 32O:
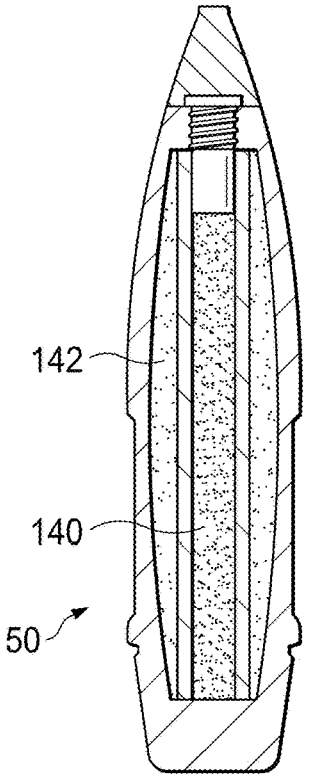
Figure 32P:
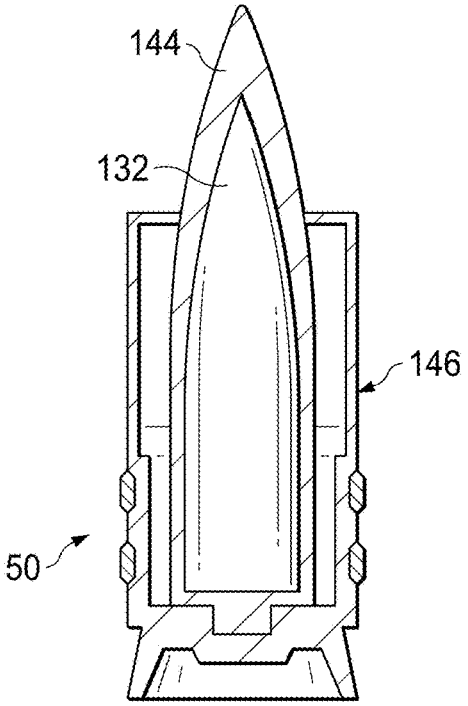
Figure 32Q:
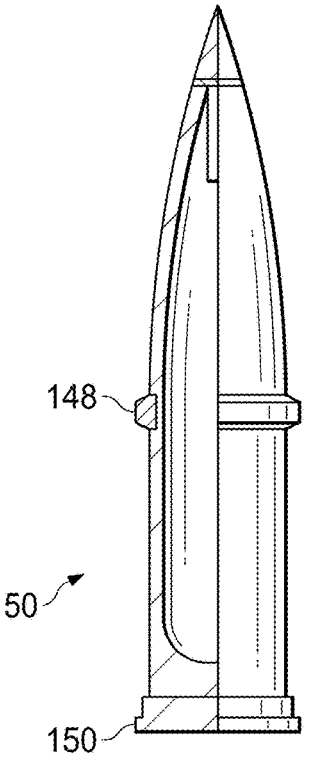
Figure 32R:
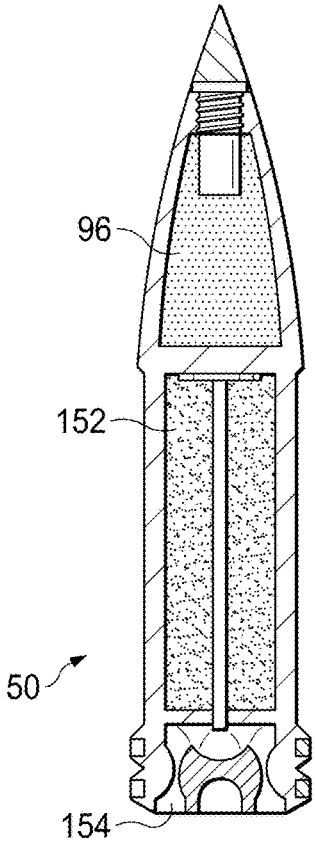
Figure 32S:
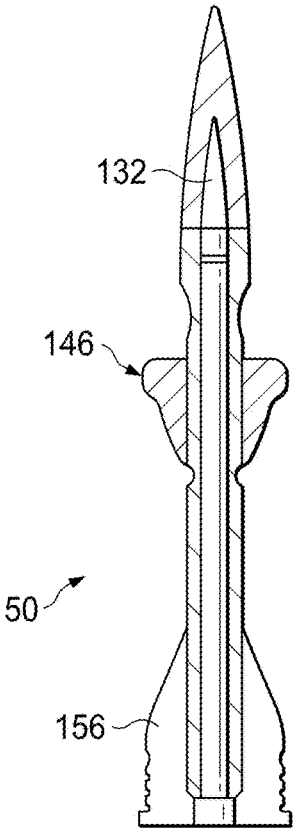

FIGS. 32A-32S are images of a cut away image of different projectile types with the treatment of the present invention. FIG. 32A is an image of a projectile 50 that is an armor piercing tracer having a boattail 62 configured end, a tracer element 90 and solid shot 92. FIG. 32B is an image of a projectile 50 that is an armor piercing high explosive projectile having a base fuse 94 and high explosive charge 96. FIG. 32C is an image of a projectile 50 that is an armor piercing high explosive projectile having a base fuse 94, high explosive charge 96 and an armor piercing shot 98 and armor piercing cap 100. FIG. 32D is an image of a projectile 50 that is a heat shaped charge projectile having a fuse 102, void space 104 and cavity 106 and a high explosive charge 96 surrounding a flash tube 108 connecting the fuse 102 and the booster 110. FIG. 32E is an image of a projectile 50 that is an anti-concrete projectile having a ballistic cap 112 housing a blunt nose 114 connected to a base fuse 94 and high explosive charge 96. FIG. 32F is an image of a projectile 50 that is a high-explosive and high capacity projectile having a high explosive 50 and a booster 110. FIG. 32G is an image of a projectile 50 that is a shrapnel projectile that includes a shrapnel projectile having a base ejection mechanism 116 and a shrapnel 118. FIG. 32H is an image of a projectile 50 that is a canister projectile having shot 120 disposed in the canister. FIG. 32I is an image of a projectile 50 that is an illuminating projectile that includes an ejection charge 122 and an illumination element 124 connected to a parachute 126 connected to a suspending cord 128. FIG. 32J is an image of a projectile 50 that is an armor piercing cap ballistic cap projectile having a base fuse 94, high explosive charge 96 and an armor piercing shot 98, armor piercing cap 100 and ballistic cap 112. FIG. 32K is an image of a projectile 50 that is a high velocity armor piercing projectile having a tracer element 90 and a light metal casing 130 over a hard dense core 132. FIG. 32L is an image of a projectile 50 that is a high velocity armor piercing arrowhead projectile having a tracer element 90 and a light metal casing 130 over a hard dense core 132. FIG. 32M is an image of a projectile 50 that is a high explosive projectile having a fuse 102, high explosive charge 96, a tracer element 90 and a rotation band 134. FIG. 32N is an image of a projectile 50 that is a high explosive chemical projectile having one or more chemicals 136 with a high explosive charge 96 and a high explosive burster 140, and a centering band 138. FIG. 32O is an image of a projectile 50 that is a smoke projectile having one or more smoke compositions 142 and a high explosive burster 140. FIG. 32P is an image of a projectile 50 that is a discarding sabot projectile having a hard core 132 covered by a outer shell 144 and a discardable carrier 146. FIG. 32Q is an image of a projectile 50 that is a tapered bore projectile having a bourrelet 148 and a rotating flange 150. FIG. 32R is an image of a projectile 50 that is a rocket assisted projectile having a high explosive charge 96 and a rocket propellant 152 with venturis 154. FIG. 32S is an image of a projectile 50 that is a discarding sabot projectile having a hard core 132 with one or more fins 156 and a discardable carrier 146. Where each projectile has received the treatment of the instant invention.

Figure 33A:
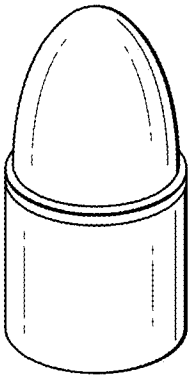
FIGS. 33A-33P are images of various projectiles of the present invention.
Figure 33B:
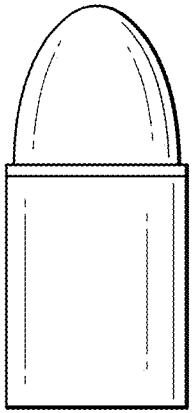
Figure 33C:
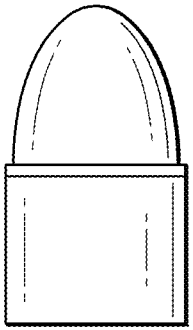
Figure 33D:
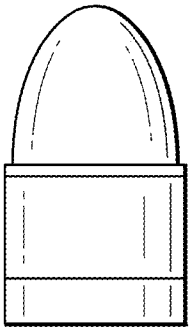
Figure 33E:
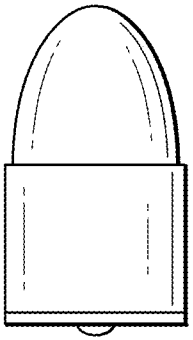
Figure 33L:
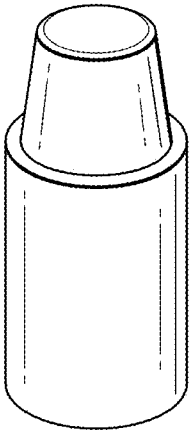
Figure 33M:
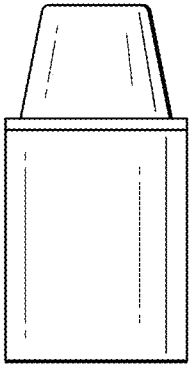
Figure 33N:
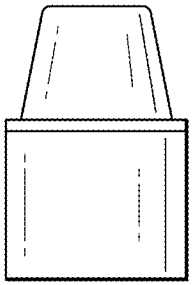
Figure 33O:
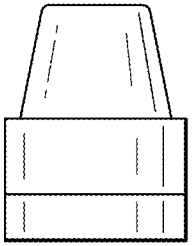
Figure 33P:
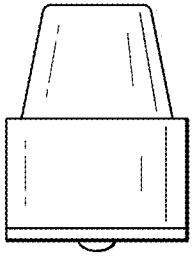

FIGS. 33A-33P are images of various projectiles of the present invention. FIG. 33*a* is a perspective view of a round point projectile. FIGS. 33B-33E are side views of a round point projectile. FIGS. 33F-33G are perspectives view of a blunt point projectile. FIGS. 33*h*-33*k* are side views of a blunt point projectile. FIG. 33*l* is a perspective view of a flat point projectile. FIGS. 33M-33P are side views of a flat point projectile.

The treatment of the present invention was performed on various bullets calibers and the velocity and the pressure compared to other treatments commonly used for bullets. The treated bullets were compared to untreated bullets of the same caliber as a control. In addition the treated bullets were compared to coated bullets, Boron Nitride (BN) coated bullets, Advanced plating TPD and ATP-H4 coatings. The tested caliber included 243 caliber 95 grain, 277 caliber 150 grain, 308 caliber 165 grain. The cartridge over all length (COAL) was 2.656 COAL for the 243 caliber 95 grain; the COAL was 3.230 COAL for the 277 caliber 150 grain and the COAL was 3.315 COAL for the 308 caliber 165 grain.

| | | | | |
|---|---|---|---|---|
| 243-95 | w.o. 42930 | 243 Win, | RP14, 39 gm, | 2.656 COAL |
| 277-150 | w.o. 43298 | 270 Win, | RP15, 57 gm, | 3.230 COAL |
| 308-165 | w.o. 43624 | 300 Win, | RP15, 78 gm, | 3.315 COAL |

| | Claimed treated bullets | | | Control bullets | | |
|---|---|---|---|---|---|---|
| | 243-95 | 277-150 | 308-165 | 243-95 | 277-150 | 308-165 |
| Pressure | | | | | | |
| ave | 48617 | 62450 | 63100 | 51302 | 66829 | 63685 |
| range | 2901 | 2920 | 2952 | 5999 | 3120 | 2814 |
| min | 47066 | 61294 | 61971 | 48825 | 65320 | 62097 |
| max | 49967 | 64214 | 64923 | 54824 | 68440 | 64911 |
| st dev | 879 | 743 | 661 | 1902 | 795 | 733 |
| Velocity | | | | | | |
| ave | 2844 | 2946 | 3215 | 2892 | 3000 | 3223 |
| range | 50 | 31 | 40 | 89 | 50 | 46 |
| min | 2818 | 2930 | 3195 | 2857 | 2979 | 3195 |
| max | 2868 | 2961 | 3235 | 2946 | 3029 | 3241 |
| st dev | 16 | 8 | 11 | 30 | 14 | 13 |

| | | | Advanced Plating | |
|---|---|---|---|---|
| | BN 243-95 | BN 308-165 | TPD 308-165 | ATP-H4 308-165 |
| Pressure | | | | |
| ave | 43899 | 62941 | 63890 | 63773 |
| range | 1754 | 3308 | 3981 | 3443 |
| min | 43180 | 61381 | 62361 | 62206 |
| max | 44934 | 64689 | 66342 | 65649 |
| st dev | 551 | 838 | 1005 | 989 |
| Velocity | | | | |
| ave | 2751 | 3212 | 3210 | 3211 |
| range | 36 | 56 | 55 | 55 |
| min | 2740 | 3190 | 3180 | 3180 |
| max | 2776 | 3246 | 3235 | 3235 |
| st dev | 11 | 15 | 15 | 14 |

When the average pressures are compared between the treated bullet and the native untreated bullet of the same caliber it is clear to see the pressures are reduced in each caliber.

Compared to untreated bullets:

Pressure for the 243: treated 48617 to untreated 51302.

Pressure for the 277: treated 62450 to untreated 66829.

Pressure for the 308: treated 63100 to untreated 63685.

Velocity for the 243: treated 2844 to untreated 2892.

Velocity for the 277: treated 2946 to untreated 3000.

Velocity for the 308: treated 3215 to untreated 3223.

Compared to BN treatment:

Pressure for the 243: treated 48617 to BN coated 43899.

Pressure for the 308: treated 63100 to BN coated 62941.

Velocity for the 243: treated 2844 to BN coated 2741.

Velocity for the 308: treated 3215 to BN coated 3212.

Compared to TPD plating:

Pressure for the 308: treated 63100 to TPD coated 63890.

Velocity for the 308: treated 3215 to BN coated 3210

Compared to ATP-H4 plating:

Pressure for the 308: treated 63100 to H4 coated 63773.

Velocity for the 308: treated 3215 to BN coated 3211.

This data clearly shows that the claimed treatment provides a dramatically reduced pressure compared to untreated. The claimed treatment provides a reduced pressure and an increase in the velocity compared to coated or plated comparable rounds.

It is understood that the shape, size and caliber of the projectile that receives the treatment is not limited to the specific embodiments disclose. Similarly, the material that is used to make the projectile is also not limited to the specific embodiments disclose. For example, the treated projectile may include at least a percentage of stainless steel including martensitic and austenitic stainless steel, steel alloys, tungsten alloys, soft magnetic alloys such as iron, iron-silicon, electrical steel, iron-nickel (50Ni-50$F_3$), low thermal expansion alloys, or combinations thereof. In one embodiment, the projectile is a mixture of stainless steel, brass and tungsten alloy. The stainless steel used in the present invention may be any 1 series carbon steels, 2 series nickel steels, 3 series nickel-chromium steels, 4 series molybdenum steels, series chromium steels, 6 series chromium-vanadium steels, 7 series tungsten steels, 8 series nickel-chromium-molybdenum steels, or 9 series silicon-manganese steels, e.g., 102, 174, 201, 202, 300, 302, 303, 304, 308, 309, 316, 316L, 316Ti, 321, 405, 408, 409, 410, 416, 420, 430, 439, 440, 446 or 601-665 grade stainless steel.

As known to those of ordinary skill in the art, stainless steel is an alloy of iron and at least one other component that imparts corrosion resistance. As such, in one embodiment, the stainless steel is an alloy of iron and at least one of chromium, nickel, silicon, molybdenum, or mixtures thereof. Examples of such alloys include, but are not limited to, an alloy containing about 1.5 to about 2.5 percent nickel, no more than about 0.5 percent molybdenum, no more than about 0.15 percent carbon, and the balance iron with a density ranging from about 7 g/cm$^3$ to about 8 g/cm$^3$; an alloy containing about 6 to about 8 percent nickel, no more than about 0.5 percent molybdenum, no more than about 0.15 percent carbon, and the balance iron with a density ranging from about 7 g/cm$^3$ to about 8 g/cm$^3$; an alloy containing about 0.5 to about 1 percent chromium, about 0.5 percent to about 1 percent nickel, no more than about 0.5 percent molybdenum, no more than about 0.2 percent carbon, and the balance iron with a density ranging from about 7 g/cm$^3$ to about 8 g/cm$^3$; an alloy containing about 2 to about 3 percent nickel, no more than about 0.5 percent molybdenum, about 0.3 to about 0.6 percent carbon, and the balance iron with a density ranging from about 7 g/cm$^3$ to about 8 g/cm$^3$; an alloy containing about 6 to about 8 percent nickel, no more than about 0.5 percent molybdenum, about 0.2 to about 0.5 percent carbon, and the balance iron with a density ranging from about 7 g/cm$^3$ to about 8 g/cm$^3$; an alloy containing about 1 to about 1.6 percent chromium, about 0.5 percent or less nickel, no more than about 0.5 percent molybdenum, about 0.9 to about 1.2 percent carbon, and the balance iron with a density ranging from about 7 g/cm$^3$ to about 8 g/cm$^3$; and combinations thereof.

Suitable tungsten alloys include an alloy containing about 2.5 to about 3.5 percent nickel, about 0.5 percent to about 2.5 percent copper or iron, and the balance tungsten with a density ranging from about 17.5 g/cm$^3$ to about 18.5 g/cm$^3$; about 3 to about 4 percent nickel, about 94 percent tungsten, and the balance copper or iron with a density ranging from about 17.5 g/cm$^3$ to about 18.5 g/cm$^3$; and mixtures thereof.

In addition to the specific treated compositions listed herein, the skill artisan recognizes the elemental composition of common commercial designations used by manufacturers and processors can be treated, e.g., C-0000 Copper and Copper Alloys; CFTG-3806-K Diluted Bronze Bearings; CNZ-1818 Copper and Copper Alloys; CNZP-1816 Copper and Copper Alloys; CT-1000 Copper and Copper Alloys; CT-1000-K Bronze Bearings; CTG-1001-K Bronze Bearings; CTG-1004-K Bronze Bearings; CZ-1000 Copper and Copper Alloys; CZ-2000 Copper and Copper Alloys; CZ-3000 Copper and Copper Alloys; CZP-1002 Copper and Copper Alloys; CZP-2002 Copper and Copper Alloys; CZP-3002 Copper and Copper Alloys; F-0000 Iron and Carbon Steel; F-0000-K Iron and Iron-Carbon Bearings; F-0005 Iron and Carbon Steel; F-0005-K Iron and Iron-Carbon Bearings; F-0008 Iron and Carbon Steel; F-0008-K Iron and Iron-Carbon Bearings; FC-0200 Iron-Copper and Copper Steel; FC-0200-K Iron-Copper Bearings; FC-0205 Iron-Copper and Copper Steel; FC-0205-K Iron-Copper-Carbon Bearings; FC-0208 Iron-Copper and Copper Steel; FC-0208-K Iron-Copper-Carbon Bearings; FC-0505 Iron-Copper and Copper Steel; FC-0508 Iron-Copper and Copper Steel; FC-0508-K Iron-Copper-Carbon Bearings; FC-0808 Iron-Copper and Copper Steel; FC-1000 Iron-Copper and Copper Steel; FC-1000-K Iron-Copper Bearings; FC-2000-K Iron-Copper Bearings; FC-2008-K Iron-Copper-Carbon Bearings; FCTG-3604-K Diluted Bronze Bearings; FD-0200 Diffusion-Alloyed Steel; FD-0205 Diffusion-Alloyed Steel; FD-0208 Diffusion-Alloyed Steel; FD-0400 Diffusion-Alloyed Steel; FD-0405 Diffusion-Alloyed Steel; FD-0408 Diffusion-Alloyed Steel; FF-0000 Soft-Magnetic Alloys; FG-0303-K Iron-Graphite Bearings; FG-0308-K Iron-Graphite Bearings; FL-4005 Prealloyed Steel; FL-4205 Prealloyed Steel; FL-4400 Prealloyed Steel; FL-4405 Prealloyed Steel; FL-4605 Prealloyed Steel; FL-4805 Prealloyed Steel; FL-48105 Prealloyed Steel; FL-4905 Prealloyed Steel; FL-5208 Prealloyed Steel; FL-5305 Prealloyed Steel; FLC-4608 Sinter-Hardened Steel; FLC-4805 Sinter-Hardened Steel; FLC-48108 Sinter-Hardened Steel; FLC-4908 Sinter-Hardened Steel; FLC2-4808 Sinter-Hardened Steel; FLDN2-4908 Diffusion-Alloyed Steel; FLDN4C2-4905 Diffusion-Alloyed Steel; FLN-4205 Hybrid Low-Alloy Steel; FLN-48108 Sinter-Hardened Steel; FLN2-4400 Hybrid Low-Alloy Steel; FLN2-4405 Hybrid Low-Alloy Steel; FLN2-4408 Sinter-Hardened Steel; FLN2C-4005 Hybrid Low-Alloy Steel; FLN4-4400 Hybrid Low-Alloy Steel; FLN4-4405 Hybrid Low-Alloy Steel; FLN4-4408 Sinter Hardened Steel; FLN4C-4005 Hybrid Low-Alloy Steel; FLN6-4405 Hybrid Low-Alloy Steel; FLN6-4408 Sinter-Hardened Steel; FLNC-4405 Hybrid Low-Alloy Steel; FLNC-4408 Sinter-Hardened Steel; FN-0200 Iron-Nickel and Nickel Steel; FN-0205 Iron-Nickel and Nickel Steel; FN-0208 Iron-Nickel and Nickel Steel; FN-0405 Iron-Nickel and Nickel Steel; FN-0408 Iron-Nickel and Nickel Steel; FN-5000 Soft-Magnetic Alloys; FS-0300 Soft-Magnetic Alloys; FX-1000 Copper-Infiltrated Iron and Steel; FX-1005 Copper-Infiltrated Iron and Steel; FX-1008 Copper-Infiltrated Iron and Steel; FX-2000 Copper-Infiltrated Iron and Steel; FX-2005 Copper-Infiltrated Iron and Steel; FX-2008 Copper-Infiltrated Iron and Steel; FY-4500 Soft-Magnetic Alloys; FY-8000 Soft-Magnetic Alloys; P/F-1020 Carbon Steel PF; P/F-1040 Carbon Steel PF; P/F-1060 Carbon Steel PF; P/F-10C40 Copper Steel PF; P/F-10C50 Copper Steel PF; P/F-10C60 Copper Steel PF; P/F-1140 Carbon Steel PF; P/F-1160 Carbon Steel PF; P/F-11C40 Copper Steel PF; P/F-11C50 Copper Steel PF; P/F-11C60 Copper Steel PF; P/F-4220 Low-Alloy P/F-42XX Steel PF; P/F-4240 Low-Alloy P/F-42XX Steel PF; P/F-4260 Low-Alloy P/F-42XX Steel PF; P/F-4620 Low-Alloy P/F-46XX Steel PF; P/F-4640 Low-Alloy P/F-46XX Steel PF; P/F-4660 Low-Alloy P/F-46XX Steel PF; P/F-4680 Low-Alloy P/F-46XX Steel PF; SS-303L Stainless Steel-300 Series Alloy; SS-303N1 Stainless Steel-300 Series Alloy; SS-303N2 Stainless Steel-300 Series Alloy; SS-304H Stainless Steel-300 Series Alloy; SS-304L Stainless Steel-300 Series Alloy; SS-304N1 Stainless Steel-300 Series Alloy; SS-304N2 Stainless Steel-300 Series Alloy; SS-316H Stainless Steel-300 Series Alloy; SS-316L Stainless Steel-300 Series Alloy; SS-316N1 Stainless Steel-300 Series Alloy; SS-316N2 Stainless Steel-300 Series Alloy; SS-409L Stainless Steel-400 Series Alloy; SS-409LE Stainless Steel-400 Series Alloy; SS-410 Stainless Steel-400 Series Alloy; SS-410L Stainless Steel-400 Series Alloy; SS-430L Stainless Steel-400 Series Alloy; SS-430N2 Stainless Steel-400 Series Alloy; SS-434L Stainless Steel-400 Series Alloy; SS-434LCb Stainless Steel-400 Series Alloy; and SS-434N2 Stainless Steel-400 Series Alloy.

Treated titanium alloys that may be used in this invention include any alloy or modified alloy known to the skilled artisan including titanium grades 5-38 and more specifically titanium grades 5, 9, 18, 19, 20, 21, 23, 24, 25, 28, 29, 35, 36 or 38. Grades 5, 23, 24, 25, 29, 35, or 36 annealed or aged; Grades 9, 18, 28, or 38 cold-worked and stress-relieved or annealed; Grades 9, 18, 23, 28, or 29 transformed-beta condition; and Grades 19, 20, or 21 solution-treated or solution-treated and aged. Grade 5, also known as Ti6Al4V, Ti-6Al-4V or Ti 6-4, is the most commonly used alloy. It has a chemical composition of 6% aluminum, 4% vanadium, 0.25% (maximum) iron, 0.2% (maximum) oxygen, and the remainder titanium. It is significantly stronger than commercially pure titanium while having the same stiffness and thermal properties (excluding thermal conductivity, which is about 60% lower in Grade 5 Ti than in CP Ti); Grade 6 contains 5% aluminum and 2.5% tin. It is also known as Ti-5Al-2.5Sn. This alloy has good weldability, stability and strength at elevated temperatures; Grade 7 and 7H contains 0.12 to 0.25% palladium. This grade is similar to Grade 2. The small quantity of palladium added gives it enhanced crevice corrosion resistance at low temperatures and high pH; Grade 9 contains 3.0% aluminum and 2.5% vanadium. This grade is a compromise between the ease of welding and manufacturing of the "pure" grades and the high strength of Grade 5; Grade 11 contains 0.12 to 0.25% palladium; Grade 12 contains 0.3% molybdenum and 0.8% nickel; Grades 13, 14, and 15 all contain 0.5% nickel and 0.05% ruthenium; Grade 16 contains 0.04 to 0.08% palladium; Grade 16H contains 0.04 to 0.08% palladium; Grade 17 contains 0.04 to 0.08% palladium; Grade 18 contains 3% aluminum, 2.5% vanadium and 0.04 to 0.08% palladium; Grade 19 contains 3% aluminum, 8% vanadium, 6% chromium, 4% zirconium, and 4% molybdenum; Grade 20 contains 3% aluminum, 8% vanadium, 6% chromium, 4% zirconium, 4% molybdenum and 0.04% to 0.08% palladium; Grade 21 contains 15% molybdenum, 3% aluminum, 2.7% niobium, and 0.25% silicon; Grade 23 contains 6% aluminum, 4% vanadium, 0.13% (maximum) Oxygen; Grade 24 contains 6% aluminum, 4% vanadium and 0.04% to 0.08% palladium. Grade 25 contains 6% aluminum, 4% vanadium and 0.3% to 0.8% nickel and 0.04% to 0.08% palladium; Grades 26, 26H, and 27 all contain 0.08 to 0.14% ruthenium; Grade 28 contains 3% aluminum, 2.5% vanadium and 0.08 to 0.14% ruthenium; Grade 29 contains 6% aluminum, 4% vanadium and 0.08 to 0.14% ruthenium; Grades 30 and 31 contain 0.3% cobalt and 0.05% palladium; Grade 32 contains 5% aluminum, 1% tin, 1% zirconium, 1% vanadium, and 0.8% molybdenum; Grades 33 and 34 contain 0.4% nickel, 0.015% palladium, 0.025% ruthenium, and 0.15% chromium; Grade 35 contains 4.5% aluminum, 2% molybdenum, 1.6% vanadium, 0.5% iron, and 0.3% silicon; Grade 36 contains 45% niobium; Grade 37 contains 1.5% aluminum; and Grade 38 contains 4% aluminum, 2.5% vanadium, and 1.5% iron. Its mechanical properties are very similar to Grade 5, but has good cold workability similar to grade 9. One embodiment includes a Ti6Al4V composition. One embodiment includes a composition having 3-12% aluminum, 2-8% vanadium, 0.1-0.75% iron, 0.1-0.5% oxygen, and the remainder titanium. More specifically, about 6% aluminum, about 4% vanadium, about 0.25% iron, about 0.2% oxygen, and the remainder titanium. For example, one Ti composition may include 10 to 35% Cr, 0.05 to 15% Al, 0.05 to 2% Ti, 0.05 to 2% $Y_2O_5$, with the balance being either Fe, Ni or Co, or an alloy consisting of 20±1.0% Cr, 4.5±0.5% Al, 0.5±0.1% $Y_2O_5$ or ThO2, with the balance being Fe. For example, one Ti composition may include 15.0-23.0% Cr, 0.5-2.0% Si, 0.0-4.0% Mo, 0.0-1.2% Nb, 0.0-3.0% Fe, 0.0-0.5% Ti, 0.0-0.5% Al, 0.0-0.3% Mn, 0.0-0.1% Zr, 0.0-0.035% Ce, 0.005-0.025% Mg, 0.0005-0.005% B, 0.005-0.3% C, 0.0-20.0% Co, balance Ni. A specific instance of a treated alloy includes Ti-6Al, 4V, among others. In addition, treated Ti—Al alloys may consists essentially of 32-38% of Al and the balance of Ti and contains 0.005-0.20% of B, and the alloy which essentially consists of the above quantities of Al and Ti and contains, in addition to the above quantity of B, up to 0.2% of C, up to 0.3% of 0 and/or up to 0.3% of N (provided that O+N add up to 0.4%) and c) 0.05-3.0% of Ni and/or 0.05-3.0% of Si, and the balance of Ti.

For example, one treated Ti composition may include 10 to 35% Cr, 0.05 to 15% Al, 0.05 to 2% Ti, 0.05 to 2% $Y_2O_5$, with the balance being either Fe, Ni or Co, or an alloy consisting of 20±1.0% Cr, 4.5±0.5% Al, 0.5±0.1% $Y_2O_5$ or $ThO_2$, with the balance being Fe. For example, one Ti composition may include 15.0-23.0% Cr, 0.5-2.0% Si, 0.0-4.0% Mo, 0.0-1.2% Nb, 0.0-3.0% Fe, 0.0-0.5% Ti, 0.0-0.5% Al, 0.0-0.3% Mn, 0.0-0.1% Zr, 0.0-0.035% Ce, 0.005-0.025% Mg, 0.0005-0.005% B, 0.005-0.3% C, 0.0-20.0% Co, balance Ni. Sample Ti-based feedstock component includes 0-45% metal powder; 15-40% binder; 0-10% Polymer (e.g., thermoplastics and thermosets); surfactant 0-3%; lubricant 0-3%; sintering aid 0-1%. Another sample Ti-based feedstock component includes about 62% $TiH_2$ powder as a metal powder; about 29% naphthalene as a binder; about 2.1-2.3% polymer (e.g., EVA/epoxy); about 2.3% SURFONIC N-100® as a Surfactant; lubricant is 1.5% stearic acid as a; about 0.4% silver as a sintering Aid. Examples of metal compounds include metal hydrides, such as $TiH_2$, and intermetallics, such as TiAl and $TiAl_3$. A specific instance of an alloy includes Ti-6Al, 4V, among others. In another embodiment, the metal powder comprises at least approximately 45% of the volume of the feedstock, while in still another, it comprises between approximately 54.6% and 70.0%. In addition, Ti—Al alloys may consists essentially of 32-38% of Al and the balance of Ti and contains 0.005-0.20% of B, and the alloy which essentially consists of the above quantities of Al and Ti and contains, in addition to the above quantity of B, up to 0.2% of C, up to 0.3% of O and/or up to 0.3% of N (provided that O+N add up to 0.4%) and c) 0.05-3.0% of Ni and/or 0.05-3.0% of Si, and the balance of Ti.

The treated projectiles of the present invention may be made by any method and of any material including high strength steels, stainless steels plus Ni and Co super alloys; refractory metals, titanium and copper alloys; and low melting point alloys like brass, bronze, zinc and aluminum. The treated projectiles of the present invention may be of stainless Steel: 304L, 316L, 17-4 PH, 15-5 PH, 420, 430, 440; Super alloys: Inconel, Hastelloy, Co-based Low Alloy Steels, 2-8% Ni (4600, 4650); Magnetic Alloys: 2-6% Si—Fe, 50% Ni—Fe, 50% Co—Fe; Alloys: Fe-36Ni (Invar), F-15 (Kovar); Materials: Pure Copper, Beryllium-Copper, Brass Steels: AISI M2, M3/2, M4, T15, M42, D2; Heavy Alloys: Tungsten-Copper, W—Fe—Ni, Molybdenum-Copper.

The present invention can be used to treat various materials including Brass compositions include MPIF CZ-1000-10 having a tensile strength of 20,000 PSI, a yield strength of 11,000 PSI, an elongation of 10.5% per inch, and an apparent hardness HRH 70-75; and MPIF CZ-2000-12 having a tensile strength of 30,000 PSI, a yield strength of 13,500 PSI, an elongation of 16% per inch, and an apparent Hardness HRH 75-80.

The present invention can be used to treated various materials including Copper compositions include MPIF C-0000-5 having a tensile strength of Tensile Strength 23,000 PSI, an elongation of 20% per inch, and an apparent hardness HRH 20-25.

The present invention can be used to treat various materials including jacketed bullets intended for even higher-velocity applications generally have a lead core that is jacketed or plated with gilding metal, cupronickel, copper alloys, or steel; a thin layer of harder metal protects the softer lead core when the bullet is passing through the barrel and during flight, which allows delivering the bullet intact to the target. There, the heavy lead core delivers its kinetic energy to the target. In addition to lead cores other more dense metals including hardened steel, tungsten, or tungsten carbide, and even a core of depleted uranium.

The present invention can be used to treat various materials including full metal jacket bullets are completely encased in the harder metal jacket, except for the base. Some bullet jackets do not extend to the front of the bullet, to aid expansion and increase lethality; these are called soft point or hollow point bullets. Steel bullets are often plated with copper or other metals for corrosion resistance during long periods of storage. Synthetic jacket materials such as nylon and Teflon can also be used as can hollow point bullets with plastic aerodynamic tips that improve accuracy and enhance expansion.

The present invention can be used to treat various materials including hard cast bullets which includes a hard lead alloy to reduce fouling of rifling grooves.

The present invention can be used to treat incendiary rounds from various materials including an explosive or flammable mixture in the tip that is designed to ignite on contact with a target. The intent is to ignite fuel or munitions in the target area, thereby adding to the destructive power of the bullet itself.

The present invention can be used to treat exploding rounds from various materials. Similar to the incendiary bullet, this type of projectile is designed to explode upon hitting a hard surface, preferably the bone of the intended target. Not to be mistaken for cannon shells or grenades with fuse devices, these bullets have only a cavity filled with a small amount of low explosive depending on the velocity and deformation upon impact to detonate.

The present invention can be used to treat tracer rounds from various materials. The tracer rounds have a hollow back, filled with a flare material. Usually this is a mixture of magnesium metal, a perchlorate, and strontium salts to yield a bright red color, although other materials providing other colors have also sometimes been used. Tracer material burns out after a certain amount of time. This type of round is also used by all branches of the United States military in combat environments as a signaling device to friendly forces. The flight characteristics of tracer rounds differ from normal bullets due to their lighter weight.

The present invention can be used to treat armor piercing rounds from various materials. Jacketed designs where the core material is a very hard, high-density metal such as tungsten, tungsten carbide, depleted uranium, or steel. A pointed tip is often used, but a flat tip on the penetrator portion is generally more effective. The most common bullet jacket material is a copper, nickel, or steel jacket over a lead core; however, other core materials may be used including depleted Uranium, Tungsten as well as other jacketing materials.

In addition multiple layer projectiles may be treated. For example, a steel core may be covered with a layer of lead that is then covered with a layer of copper; a depleted Uranium may be covered with a layer of Tungsten that is then covered with a layer of copper; a steel core may be covered with a layer of lead that is then covered with a polymer layer; a pelleted core (e.g., small lead pellets, plastic, or a silicone rubber material) may be covered with a layer of lead, copper or polymer; or other variations.

The present invention can be used to treat various materials including nontoxic shot such as steel, bismuth, tungsten, and other exotic bullet alloys prevent release of toxic lead into the environment.

The present invention can be used to treat rounds from various materials including blended-metals such as bullets made using cores from powdered metals and mixtures of different powered metals.

The present invention can be used to treat frangible rounds from various materials. These are designed to disintegrate into tiny particles upon impact to minimize their penetration for reasons of range safety, to limit environmental impact, or to limit the shoot-through danger behind the intended target. The bullet may be made from an amalgam of metal and a hard frangible plastic binder designed to penetrate a human target and release its component shot pellets without exiting the target.

The present invention can be used to treat various materials including solid or monolithic solid metal rounds including mono-metal bullets intended for deep penetration with slender shaped very-low-drag projectiles for long range shooting. Such metals include oxygen free copper and alloys like copper nickel, tellurium copper and brass including UNS C36000 Free-Cutting Brass.

The present invention can be used to treat sabot rounds from various materials. The sabot round may include a multiple piece bullet having a smaller bullet surrounded by a larger carrier bullet (or sabot) that passes through the barrel and once leaving the barrel the sabot and the smaller bullet separate with the sabot falling to the ground fairly close to the barrel and the light weighted smaller bullet traveling down range at a high velocity without any identifiable rifling characteristics.

The description of the preferred embodiments should be taken as illustrating, rather than as limiting, the present invention as defined by the claims. As will be readily appreciated, numerous combinations of the features set forth above can be utilized without departing from the present invention as set forth in the claims. Such variations are not regarded as a departure from the spirit and scope of the invention, and all such modifications are intended to be included within the scope of the following claims.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

What is claimed is:

1. A method of reducing the friction between a projectile and a barrel comprising the steps of:

providing a projectile;

treating the projectile to reduce the friction of the projectile when discharged, by contacting the projectile with a solution to form a treated projectile having, an atomic Ca concentration of about 20 percent, an atomic C concentration of about 65 percent, an atomic O concentration of about 10 percent, and an atomic Fe concentration of about 3 percent dispersed within at least a portion of an interior portion of the treated projectile, wherein the treated projectile reduces the friction of the treated projectile when compared to an untreated projectile;

providing a cartridge comprising a body having a propellant chamber at least partially filled with a propellant, a primer, and a projectile aperture; and inserting the treated projectile into the projectile aperture.

2. The method of claim 1, wherein the atomic concentration is determined by an Auger microanalysis.

3. The method of claim 1, wherein the treated projectile comprises a 5.56 mm, 7.62 mm, 0.308 inch, 0.338 inch, .30-30 caliber, .30-06 caliber, 50 caliber, 45 caliber, 380 caliber, 38 caliber, 9 mm, 10 mm, 12.7 mm, 14.5 mm, 14.7 mm, 20 mm, 25 mm, 30 mm, 40 mm, 57 mm, 60 mm, 75 mm, 76 mm, 81 mm, 90 mm, 100 mm, 105 mm, 106 mm, 115 mm, 120 mm, 122 mm, 125 mm, 130 mm, 152 mm, 155 mm, 165 mm, 175 mm, 203 mm, 460 mm, 8 inch, or 4.2 inch projectile.

4. The method of claim 1, wherein the treated projectile does not fragment on impact.

5. The method of claim 1, wherein the treated projectile produces a backpressure that is reduced by at least 5% when compared to an untreated projectile.

6. A method of increasing the life of a gun barrel comprising the steps of: providing a cartridge comprising a treated projectile treated to reduce the friction of the projectile when discharged, wherein the treated projectile has, an atomic Ca concentration of about 20 percent, an atomic C concentration of about 65 percent, an atomic O concentration of about 10 percent, and an atomic Fe concentration of about 3 percent dispersed within at least a portion of an interior portion of the treated projectile, wherein the treated projectile reduces the friction of the treated projectile when compared to an untreated projectile; the cartridge comprising a body having a propellant chamber at least partially filled with a propellant, a primer, and a projectile aperture; and the treated projectile inserted into the projectile aperture, wherein the treated projectile has a reduced friction with the gun barrel compared to an untreated projectile thereby increasing the life of the gun barrel.

* * * * *